US012295479B2

(12) United States Patent
Lee

(10) Patent No.: US 12,295,479 B2
(45) Date of Patent: May 13, 2025

(54) STICK-TYPE CONTAINER

(71) Applicant: KOREATECH Co., Ltd., Seoul (KR)

(72) Inventor: Dong Yol Lee, Seoul (KR)

(73) Assignee: KOREATECH CO., LTD., Seoul (KR)

( * ) Notice: Subject to any disclaimer, the term of this patent is extended or adjusted under 35 U.S.C. 154(b) by 0 days.

(21) Appl. No.: 18/690,547

(22) PCT Filed: Sep. 16, 2022

(86) PCT No.: PCT/KR2022/013875
§ 371 (c)(1),
(2) Date: Mar. 8, 2024

(87) PCT Pub. No.: WO2023/068563
PCT Pub. Date: Apr. 27, 2023

(65) Prior Publication Data

US 2024/0374014 A1 Nov. 14, 2024

(30) Foreign Application Priority Data

Oct. 22, 2021 (KR) ..... 10-2021-0141528
Sep. 15, 2022 (KR) ..... 10-2022-0116345

(51) Int. Cl.
*A45D 40/06* (2006.01)
*A45D 40/00* (2006.01)
*A45D 40/16* (2006.01)

(52) U.S. Cl.
CPC ..... *A45D 40/16* (2013.01); *A45D 40/06* (2013.01); *A45D 2040/0025* (2013.01)

(58) Field of Classification Search
CPC ..... A45D 40/16; A45D 40/06; A45D 2040/0025; A45D 40/00; A45D 40/4002;
(Continued)

(56) References Cited

U.S. PATENT DOCUMENTS 7,021,849 B2 * 4/2006 Ramet ..... A45D 40/262 401/176
12,053,077 B2 * 8/2024 Seguin ..... A45D 40/00
(Continued)

FOREIGN PATENT DOCUMENTS

JP 61-106120 U 7/1986
JP 2001025409 A 1/2001
(Continued)

*Primary Examiner* — David J Walczak
(74) *Attorney, Agent, or Firm* — Birch, Stewart, Kolasch & Birch, LLP

(57) ABSTRACT

A stick-type container includes a contents holder to allow contents to be loaded therein, a body, an elevation member to ascend and descend to adjust exposure of the contents, and a holder support unit disposed in the body and to be detachably coupled to the contents holder to support the contents holder. The holder support unit includes a holder support body having a hollow portion, a cylindrical or polyhedral shape, and coupled to the body, a holder moving part disposed in the hollow portion and having an upper coupling portion detachably coupled to the contents holder, and an elastic support part disposed in the hollow portion and located under the upper coupling portion to support the upper coupling portion.

25 Claims, 36 Drawing Sheets

(58) Field of Classification Search
CPC ..... A45D 40/10; A45D 2040/204; A45D 40/205; A45D 2040/208
USPC ..... 401/75–78, 88, 171, 172
See application file for complete search history.

(56) References Cited

U.S. PATENT DOCUMENTS

| | | | |
|---|---|---|---|
| 2017/0245620 | A1 | 8/2017 | Kim |
| 2019/0029399 | A1 | 1/2019 | Kim |
| 2020/0022479 | A1 | 1/2020 | Lee |
| 2021/0076803 | A1 | 3/2021 | Trochel |
| 2021/0112946 | A1 | 4/2021 | Kim et al. |

FOREIGN PATENT DOCUMENTS

| | | | |
|---|---|---|---|
| JP | 2013180037 | A | 9/2013 |
| JP | 6212658 | B2 | 10/2017 |
| JP | 2019528927 | A | 10/2019 |
| KR | 20-0388883 | Y1 | 7/2005 |
| KR | 20-0393383 | Y1 | 8/2005 |
| KR | 20-0397589 | Y1 | 10/2005 |
| KR | 10-1532539 | B1 | 7/2015 |
| KR | 10-1643119 | B1 | 7/2016 |
| KR | 10-2018-0127753 | A | 11/2018 |
| KR | 10-1944399 | B1 | 1/2019 |
| KR | 101957853 | B1 | 3/2019 |
| KR | 10-2038419 | B1 | 10/2019 |
| KR | 10-2020-0097754 | A | 8/2020 |
| KR | 10-2021-0006778 | A | 1/2021 |
| KR | 10-2021-0009818 | A | 1/2021 |
| KR | 20-0493090 | Y1 | 1/2021 |
| KR | 10-2021-0097018 | A | 8/2021 |
| KR | 102482185 | B1 | 12/2022 |
| KR | 102484068 | B1 | 1/2023 |
| KR | 102517535 | B1 | 4/2023 |

* cited by examiner

【FIG. 1】
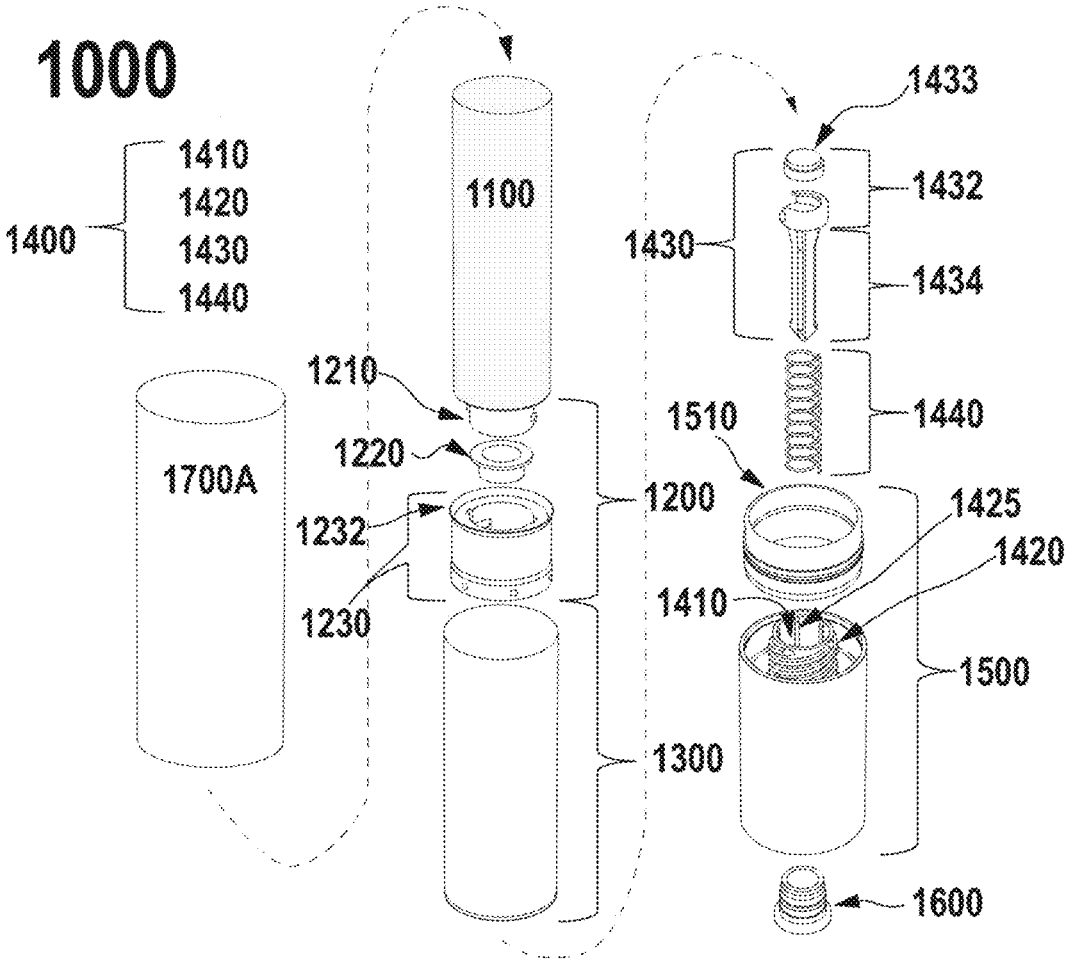

【FIG. 2】
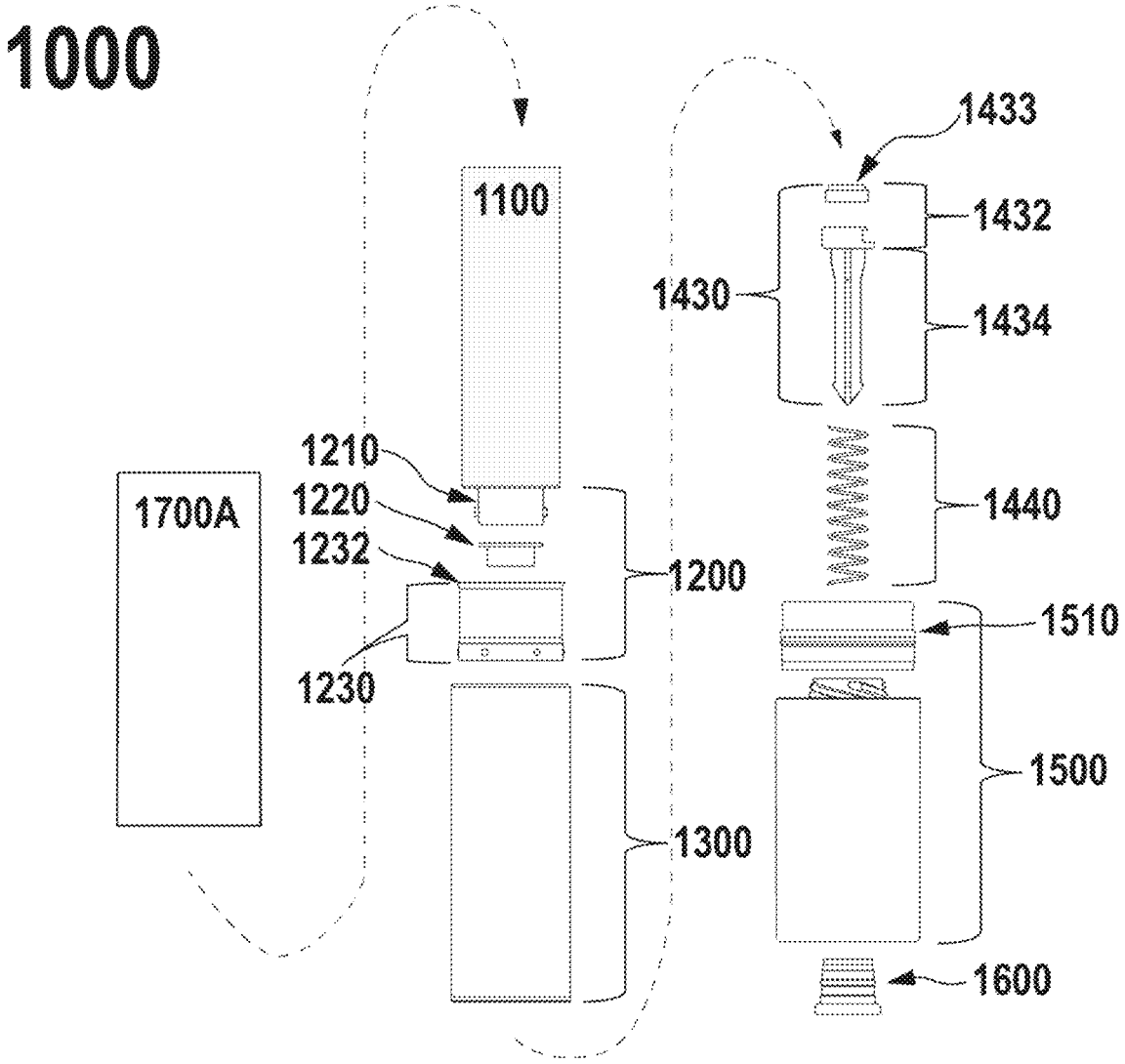

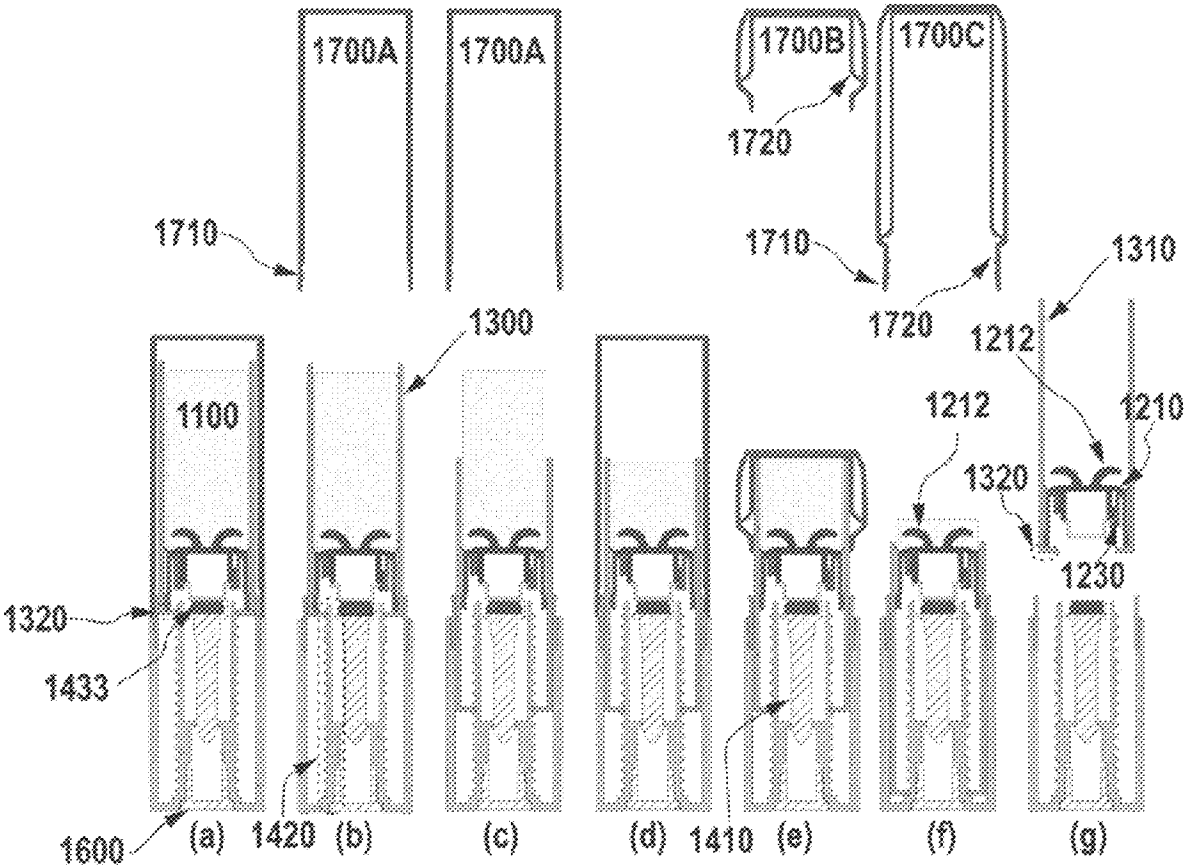
[FIG. 3]

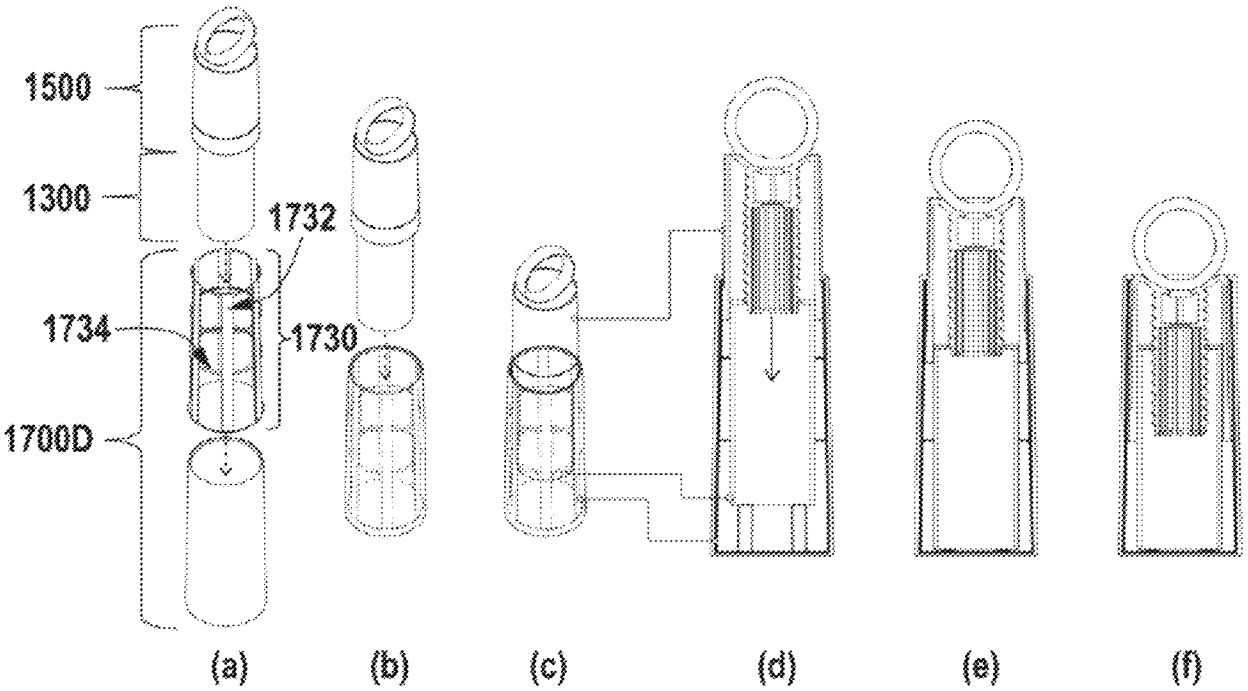
[FIG. 4]

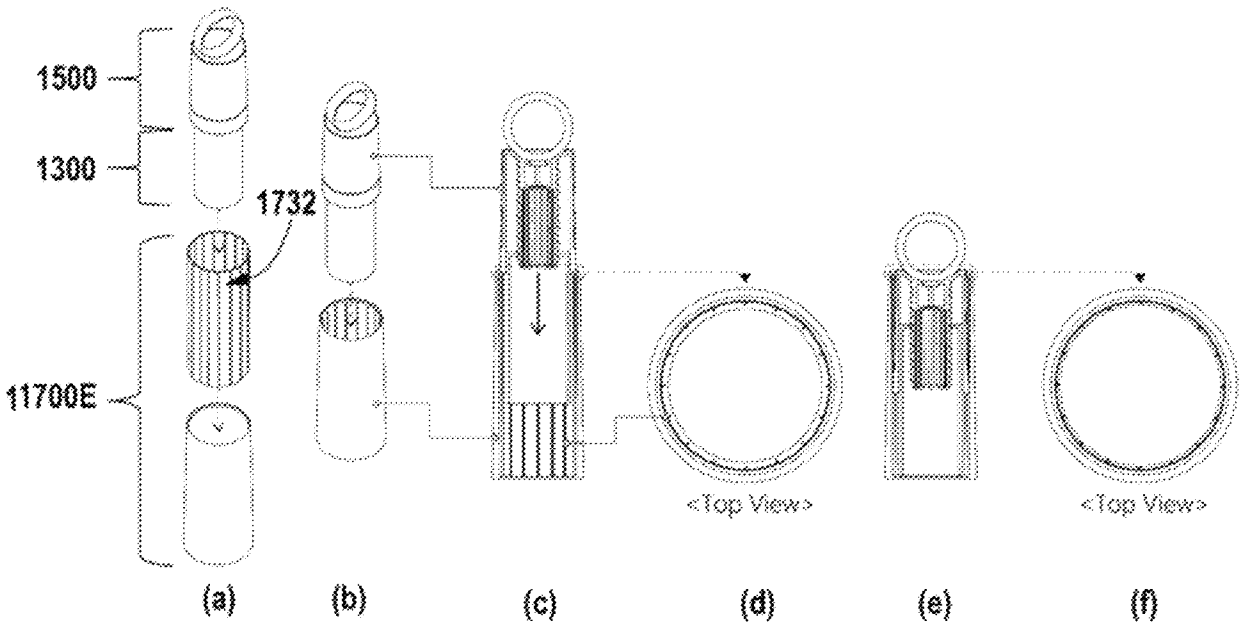
[FIG. 5]

【FIG. 6】
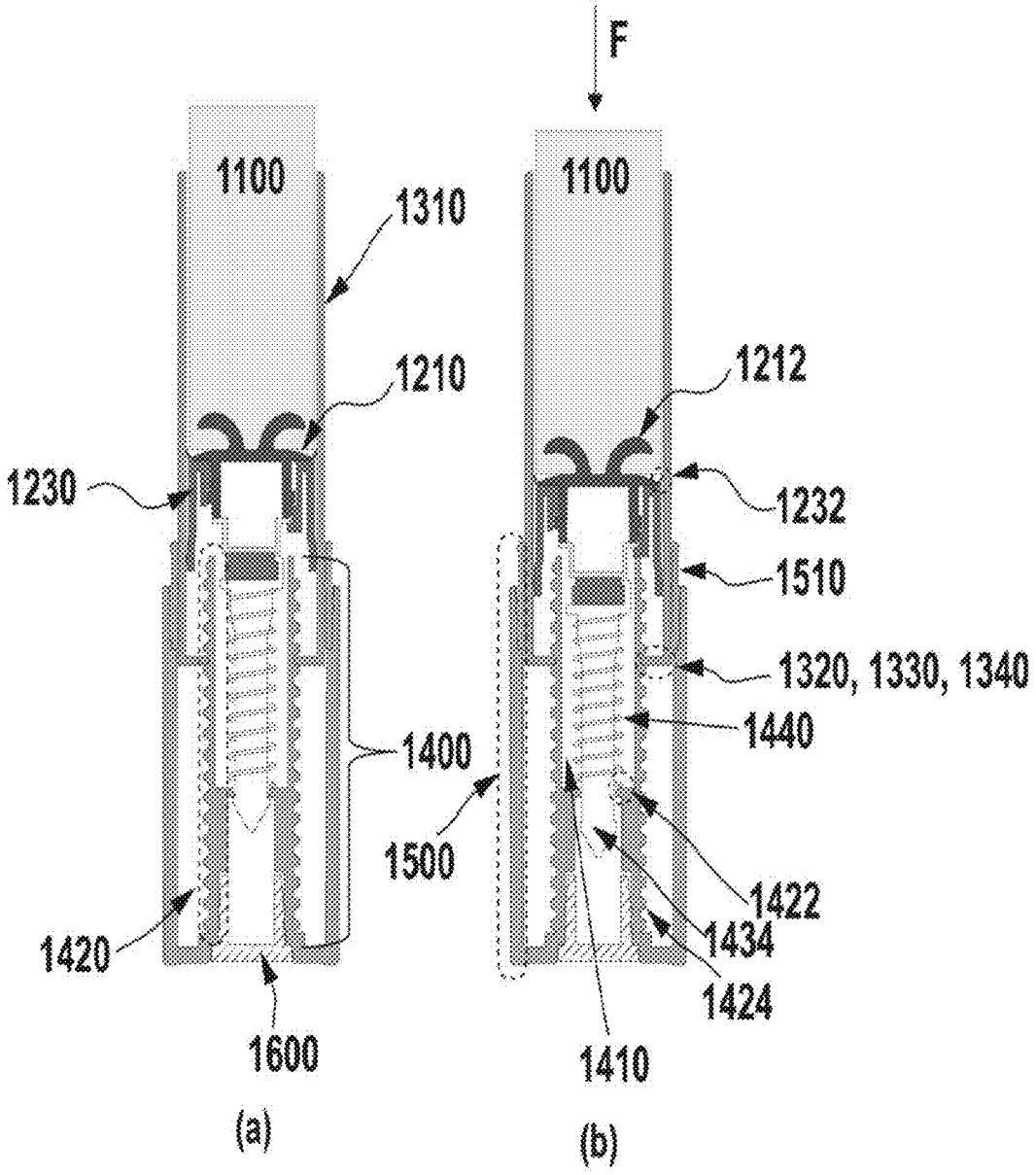

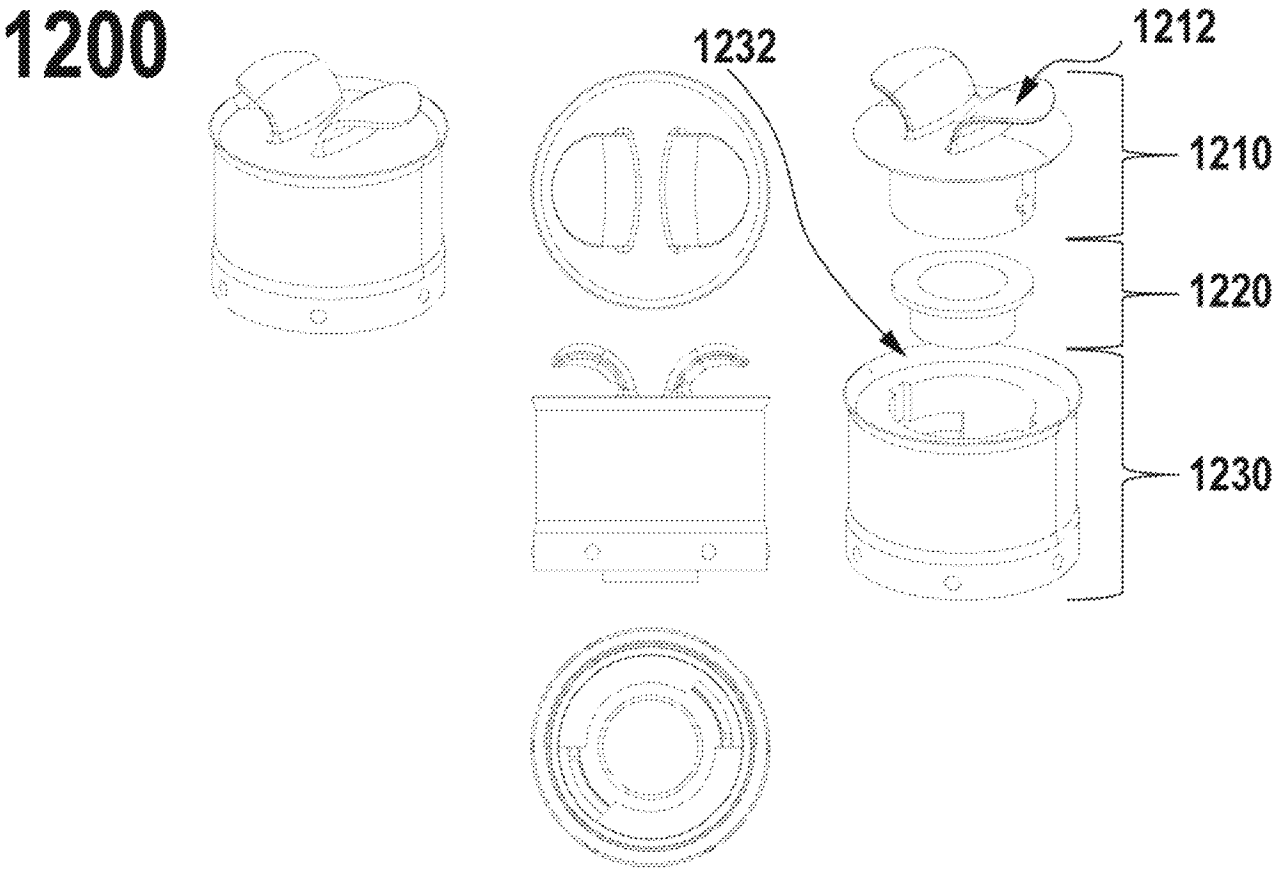
[FIG. 7]

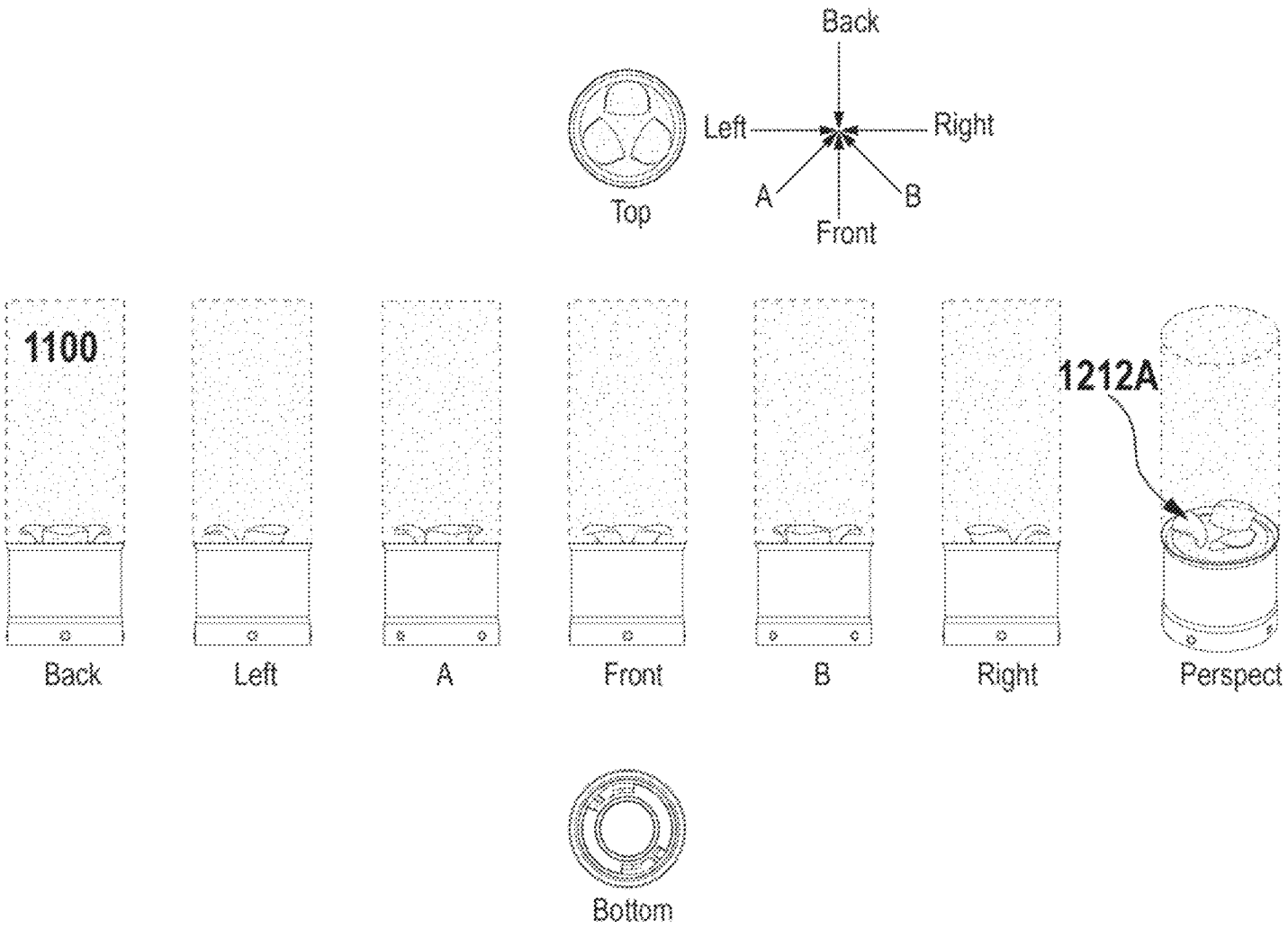
[FIG. 8]

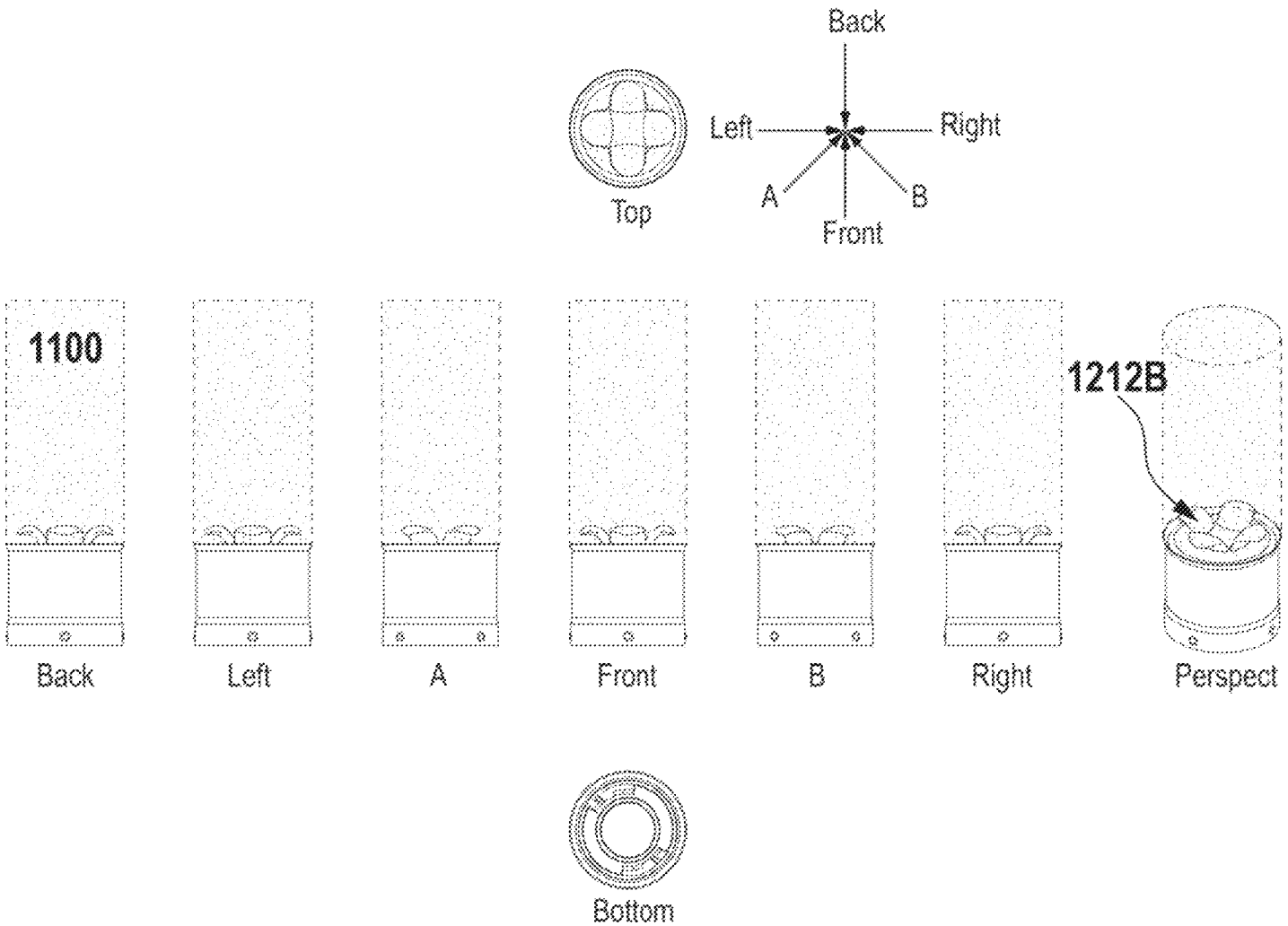
[FIG. 9]

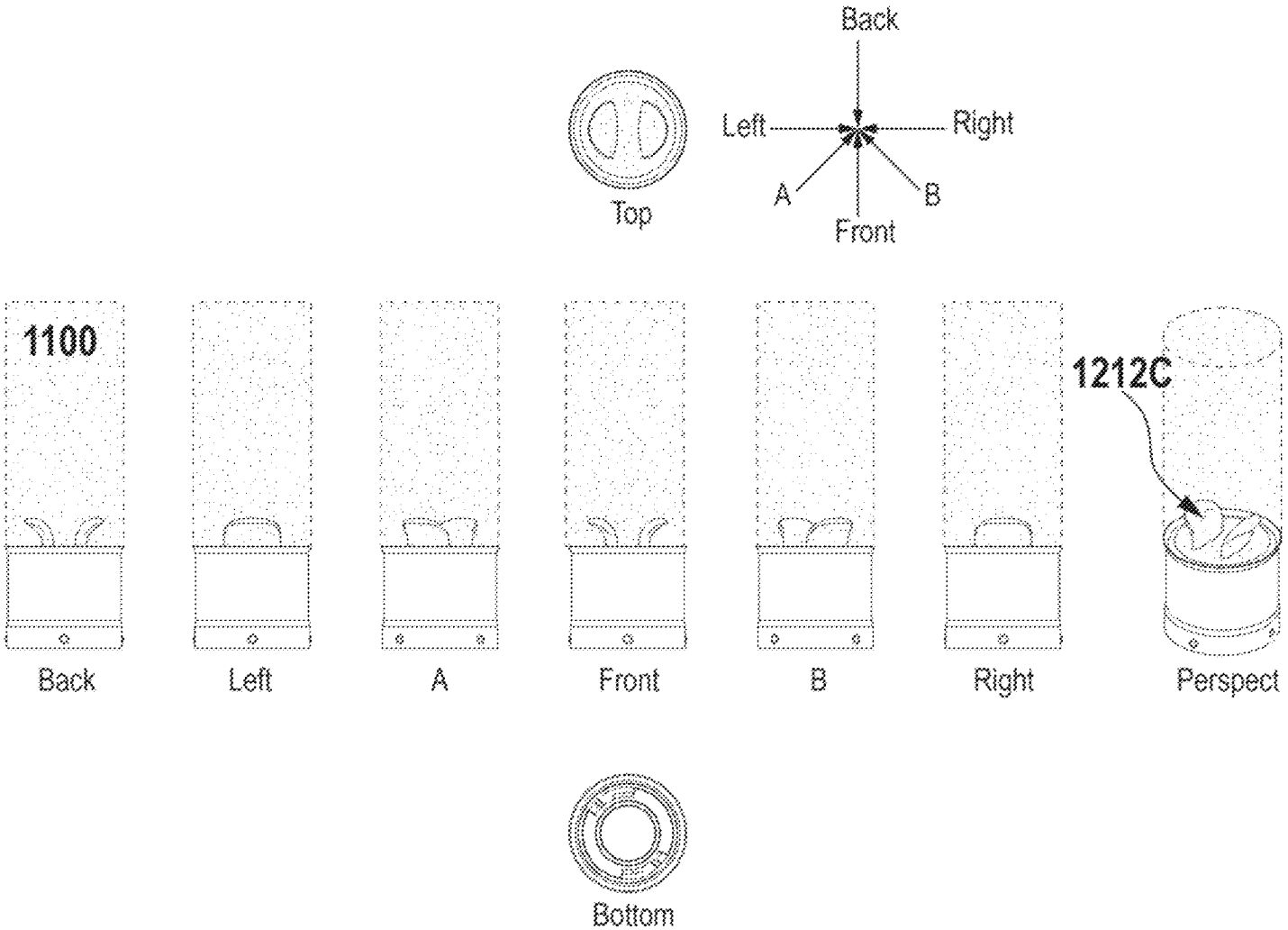
[FIG. 10]

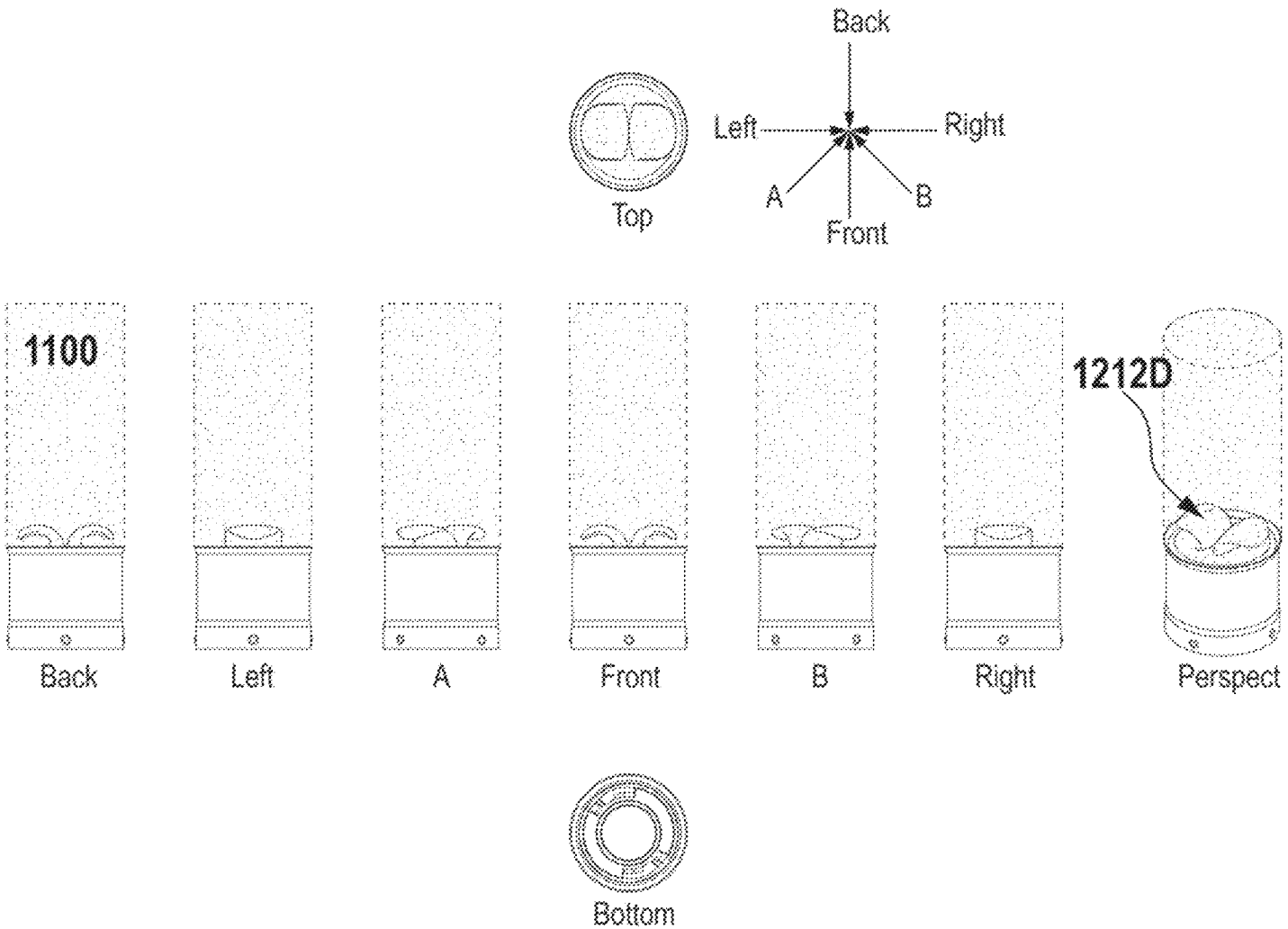
【FIG. 11】

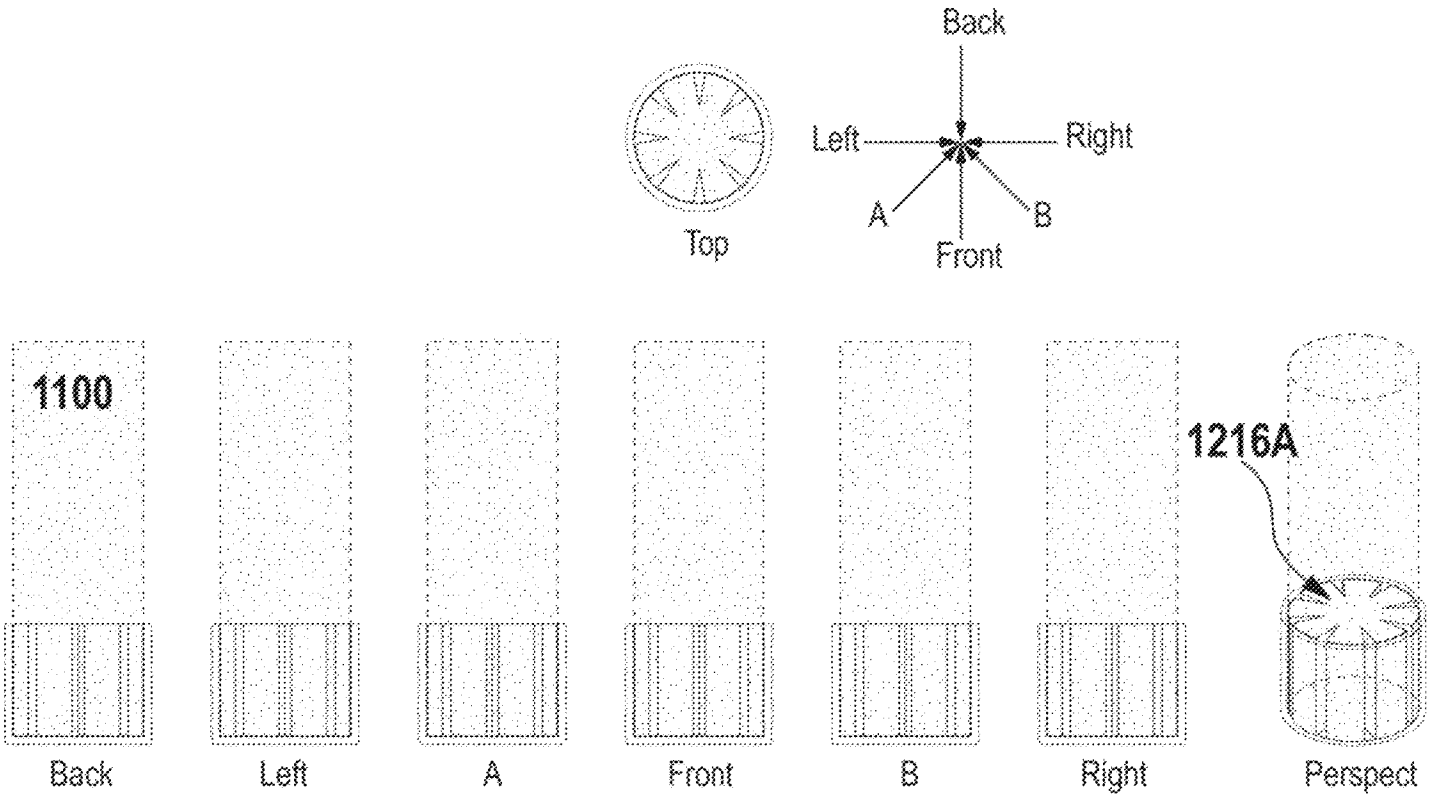
[FIG. 12]

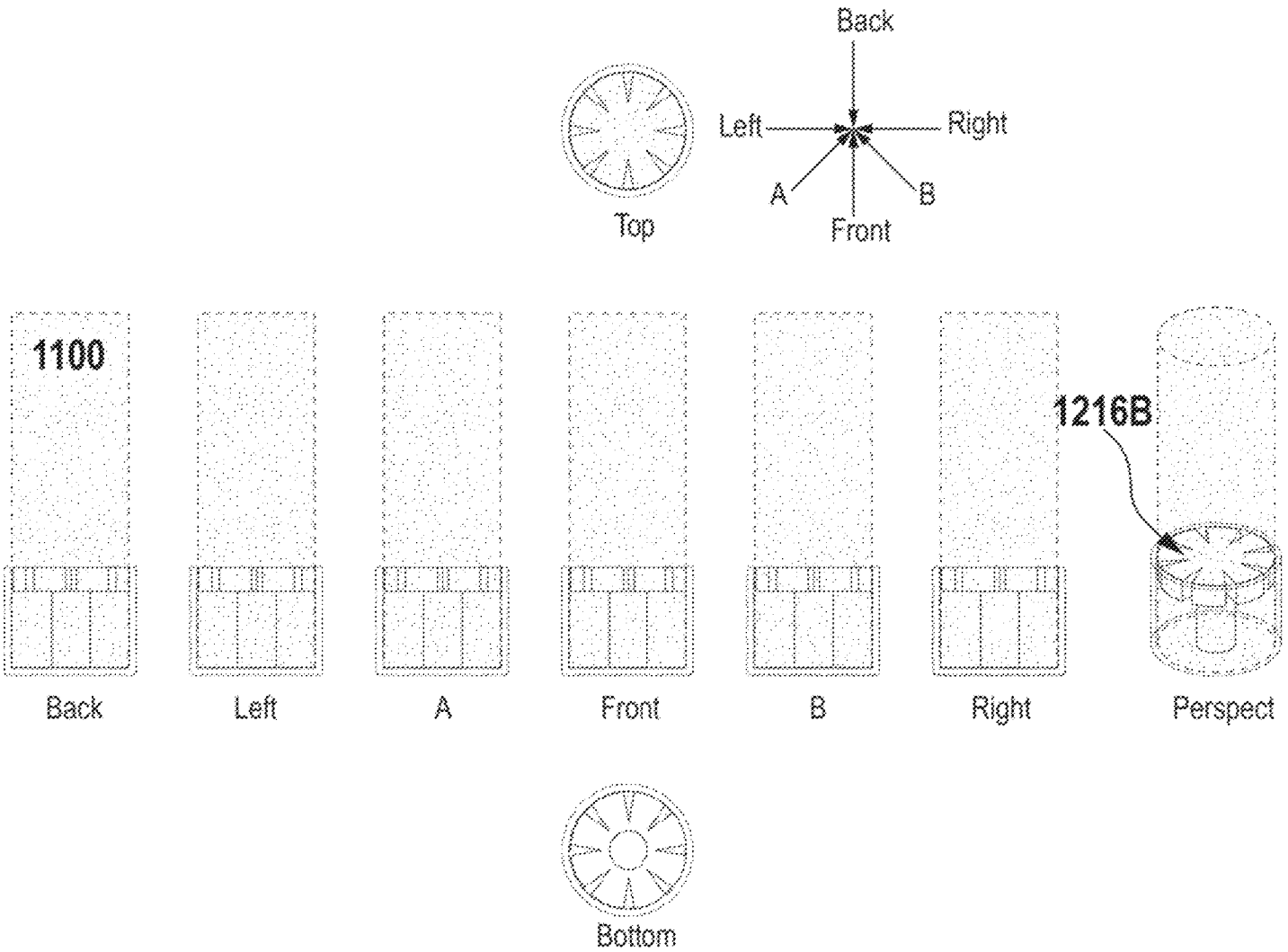
[FIG. 13]

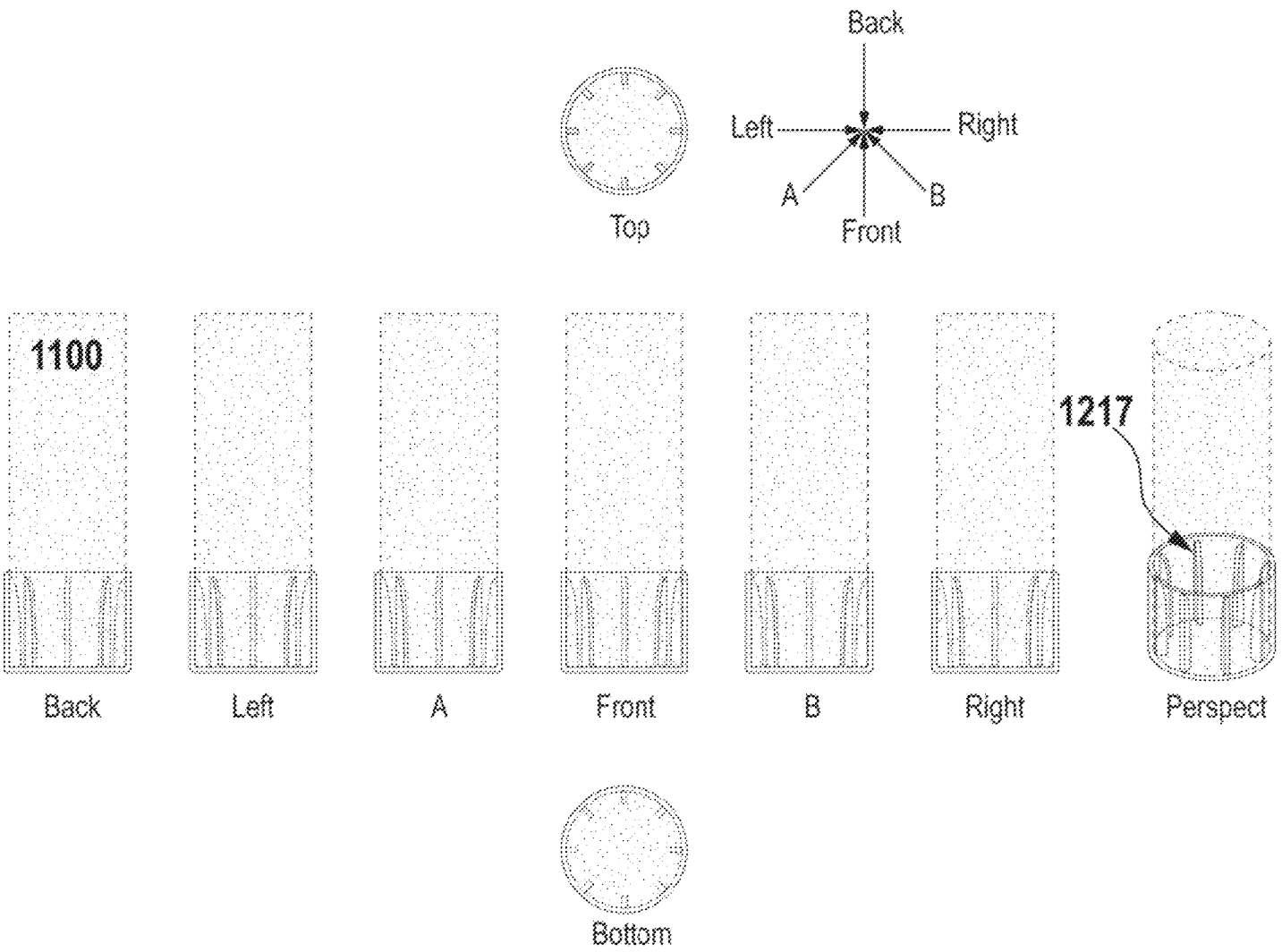
[FIG. 14]

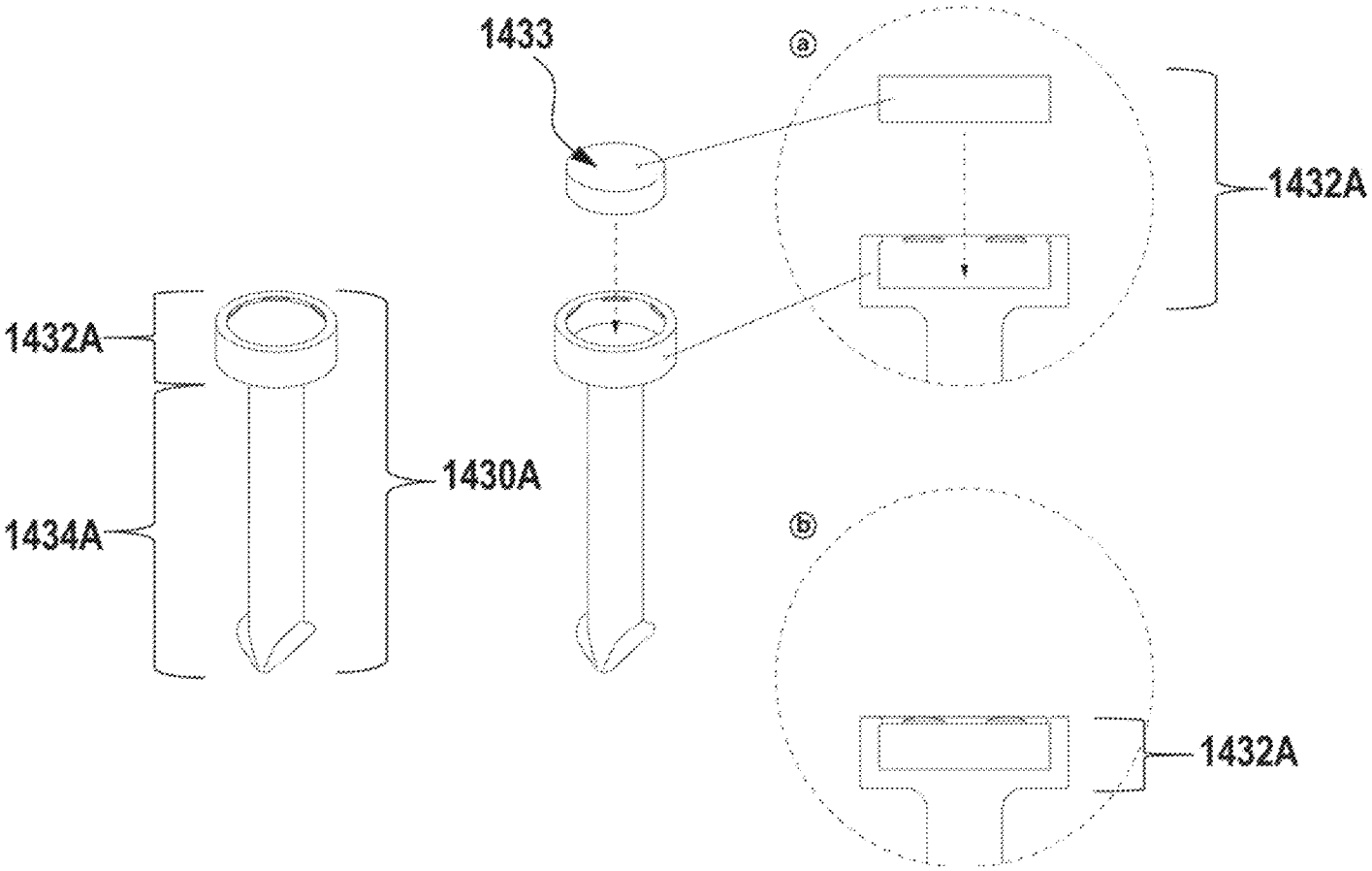
[FIG. 15]

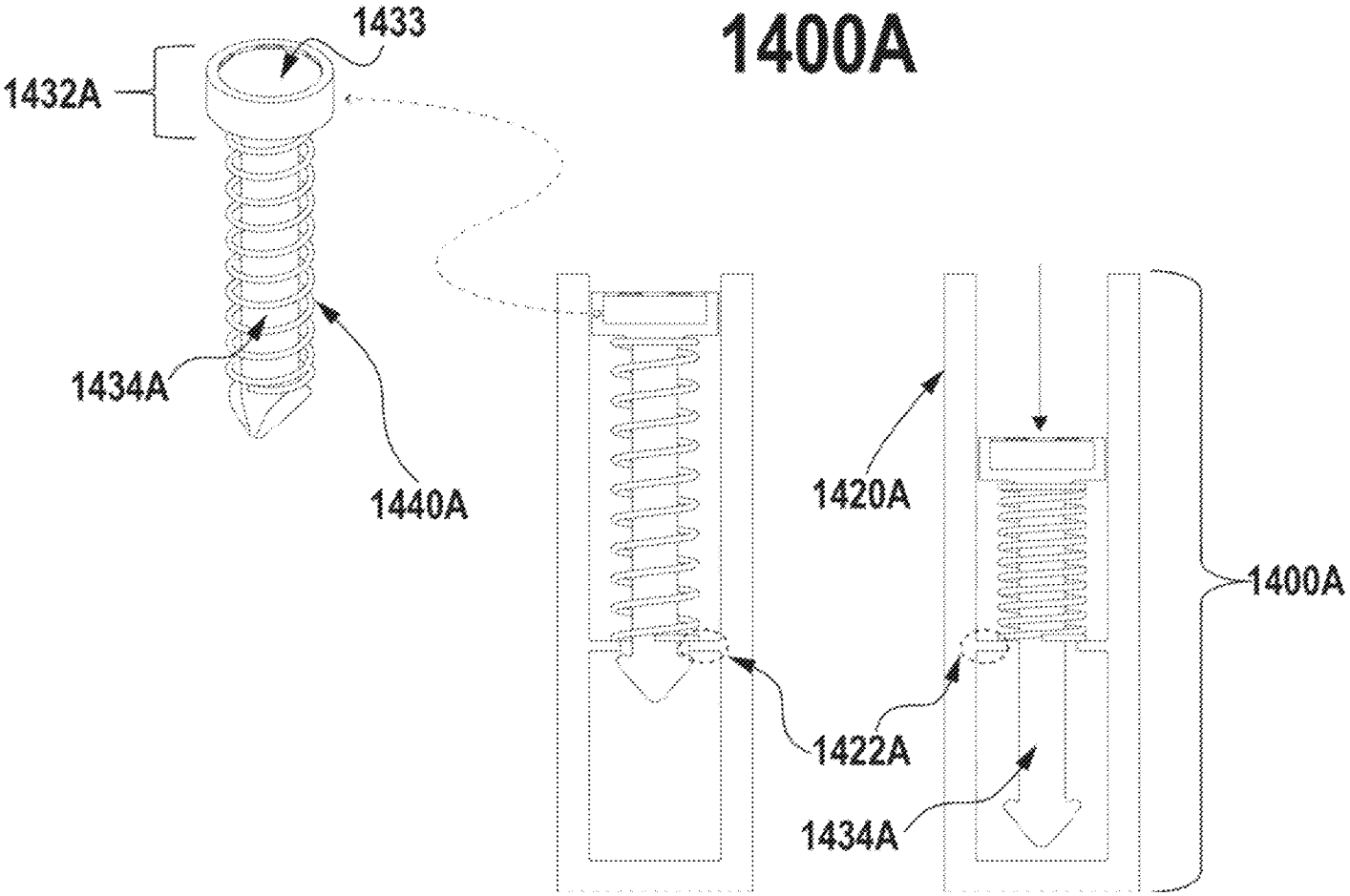
[FIG. 16]

【FIG. 17】
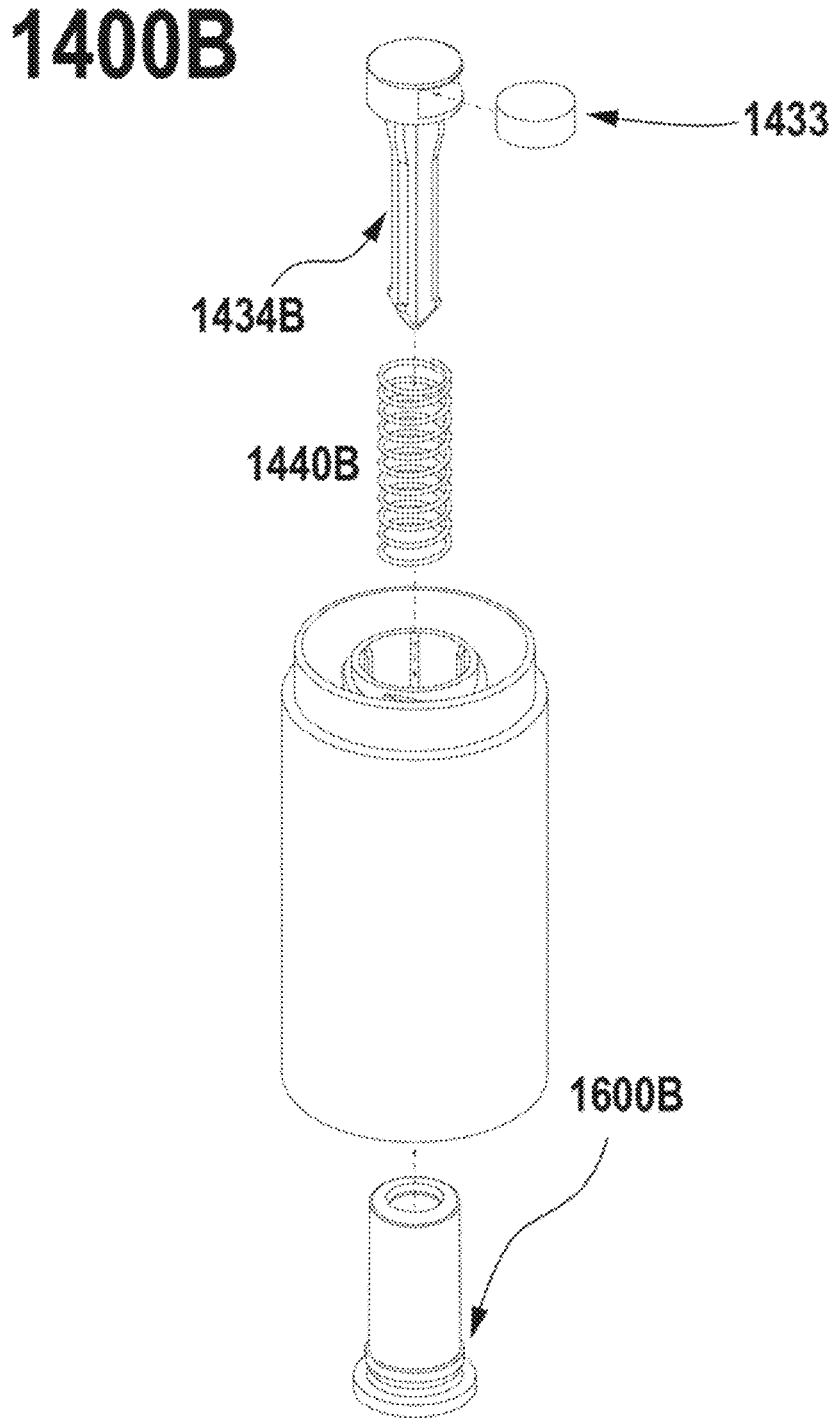

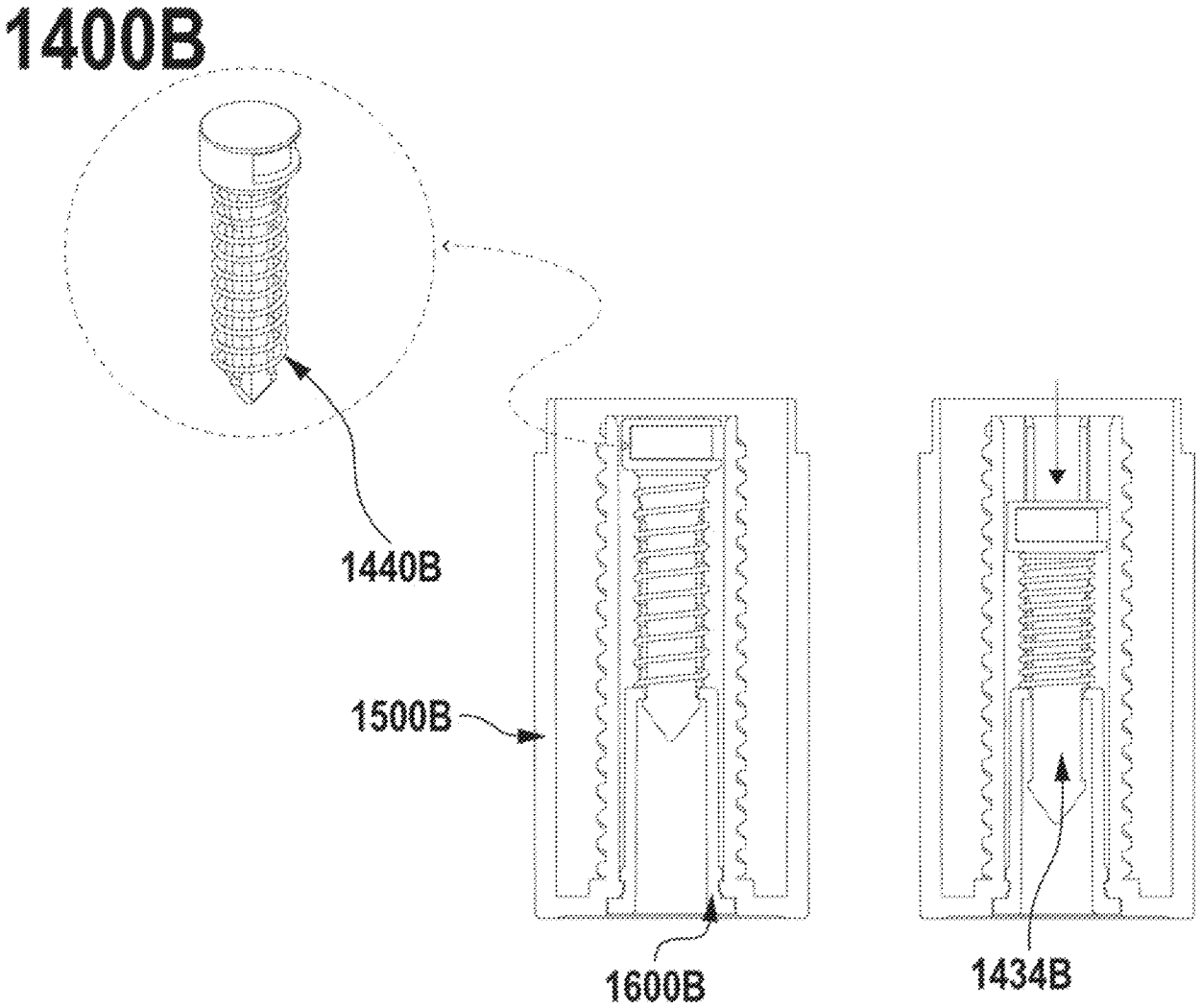
[FIG. 18]

【FIG. 19】
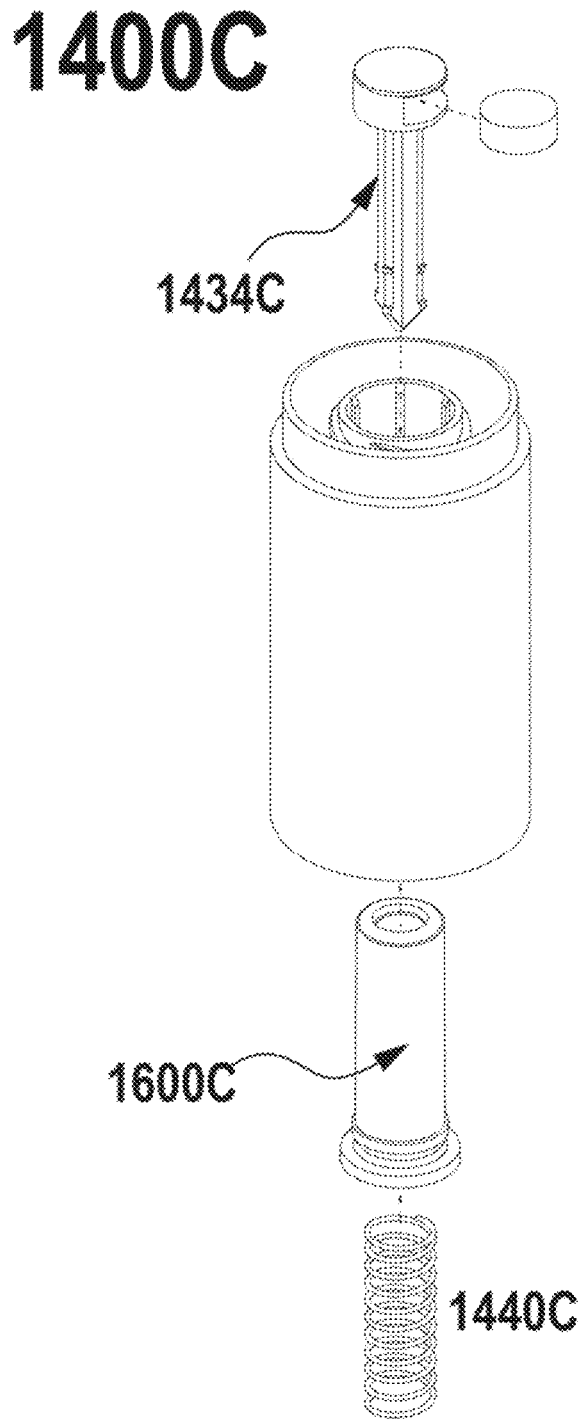

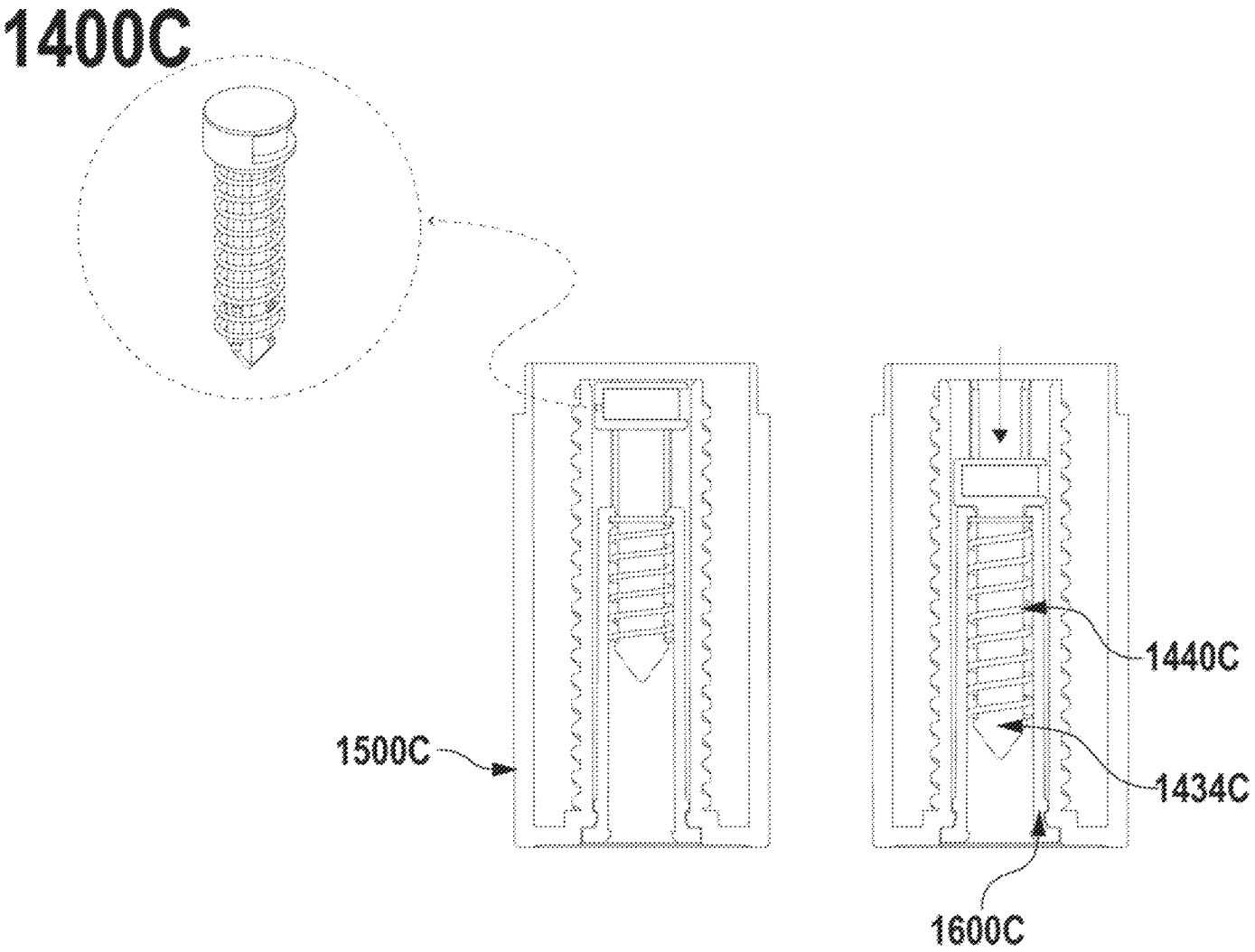
[FIG. 20]

【FIG. 21】
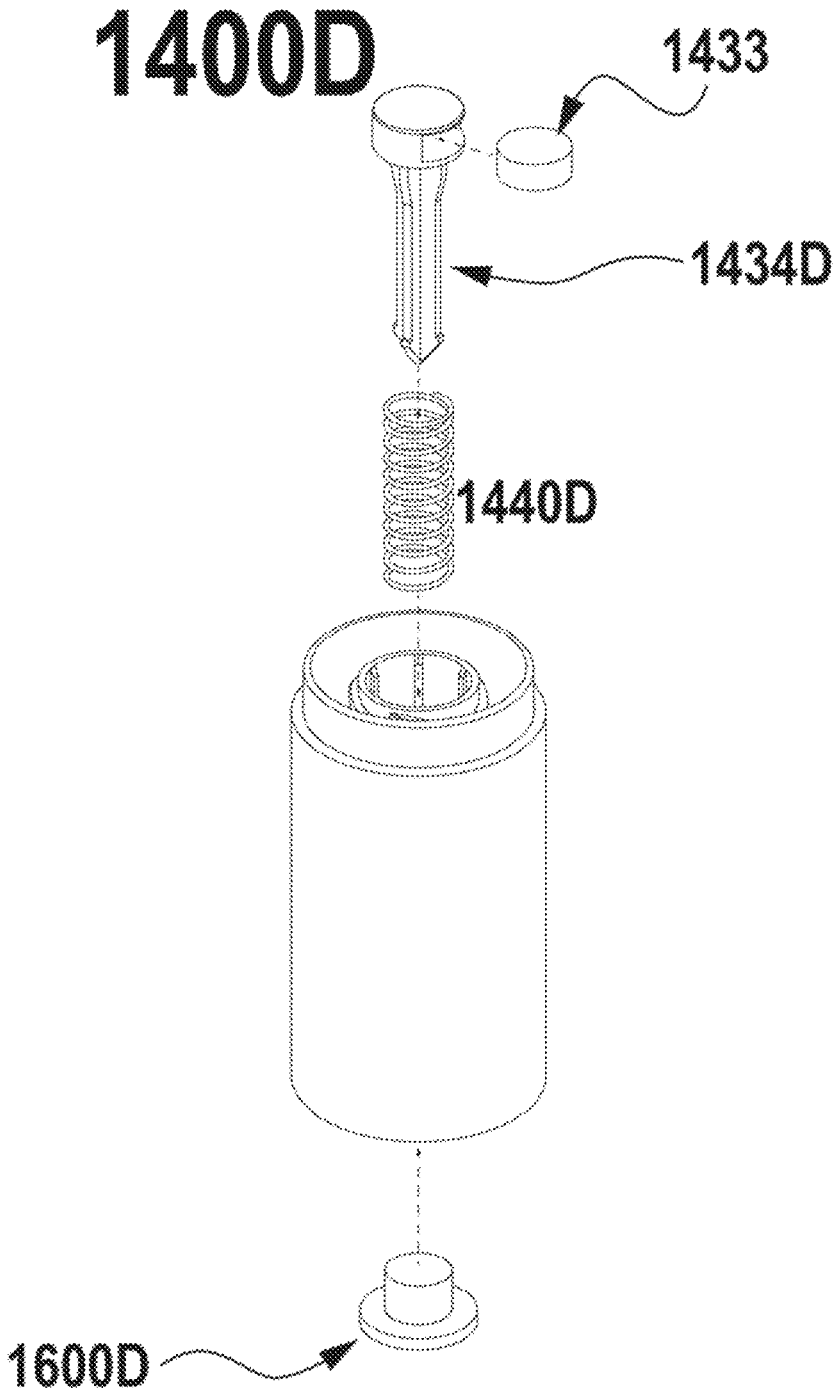

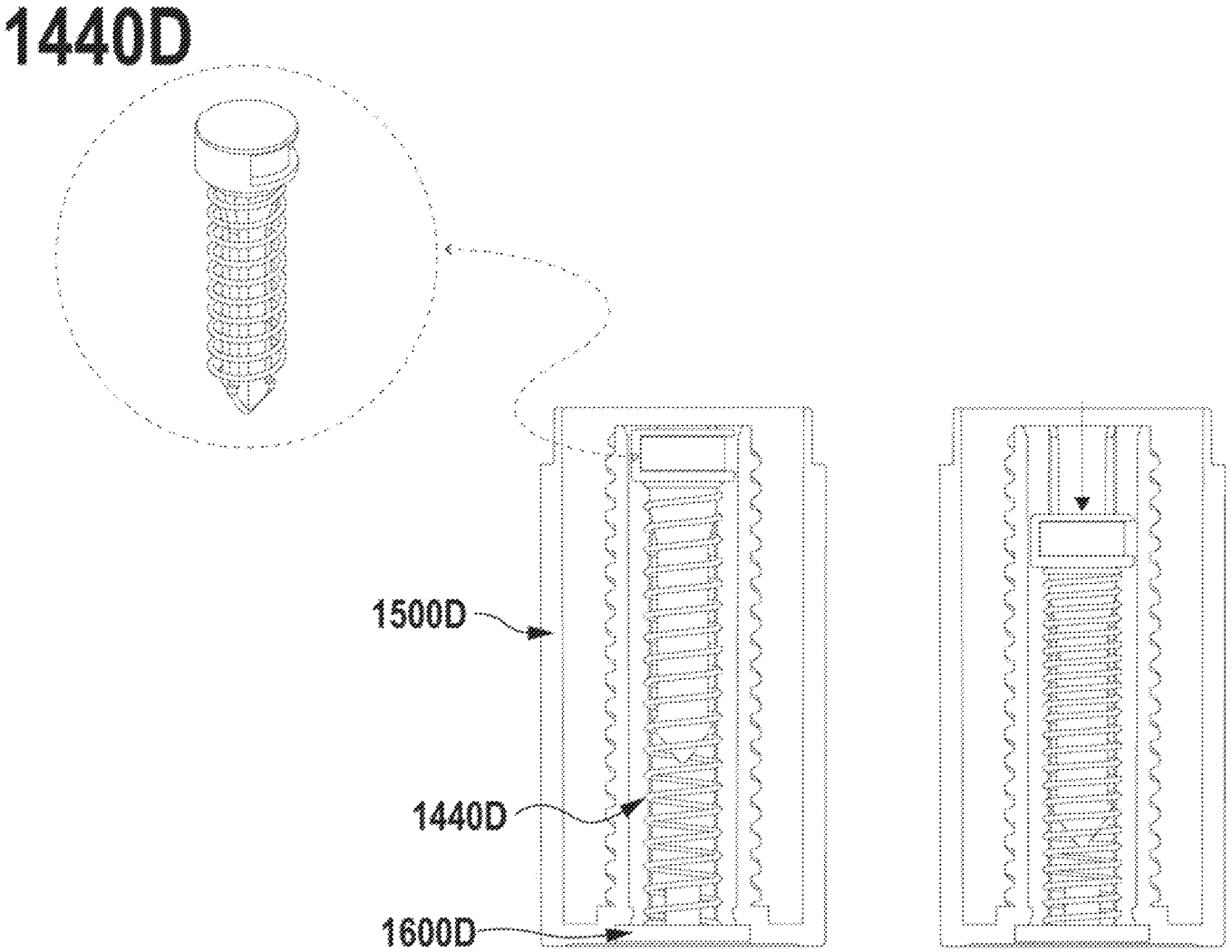
[FIG. 22]

【FIG. 23】
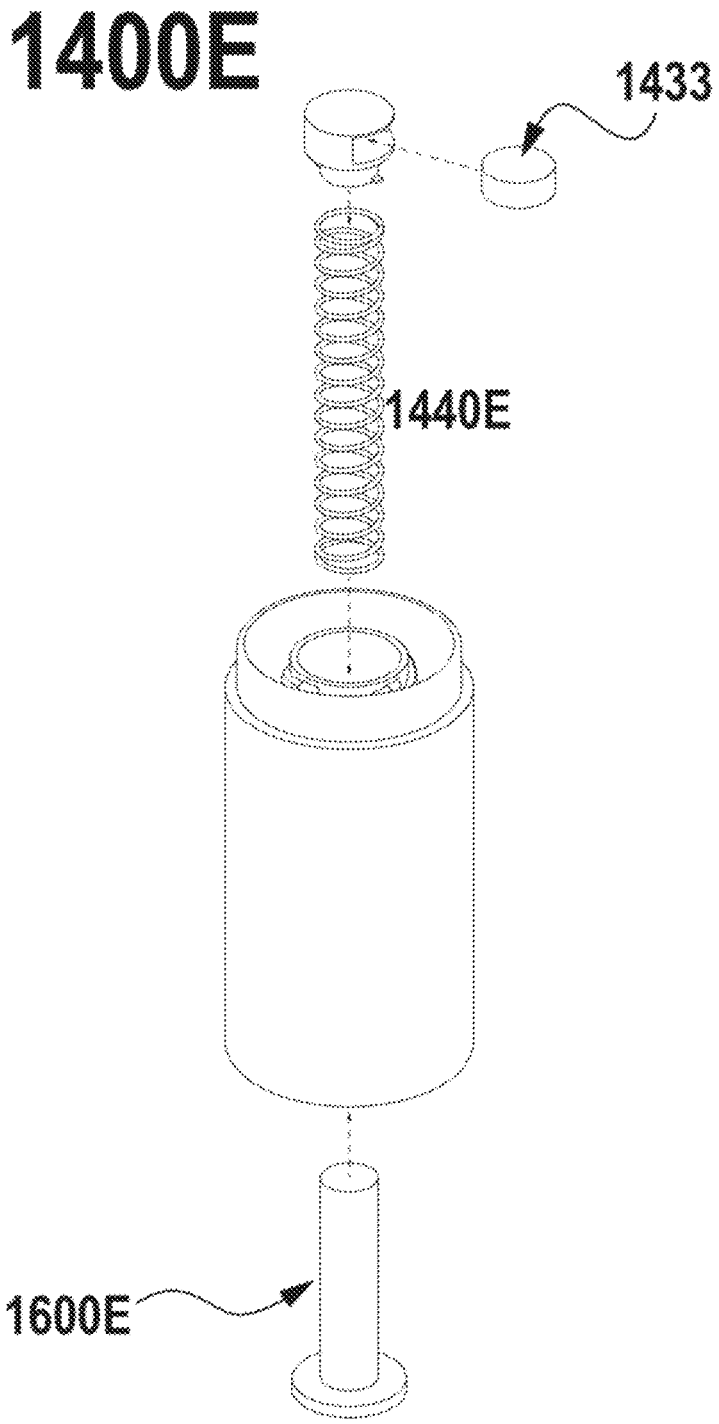

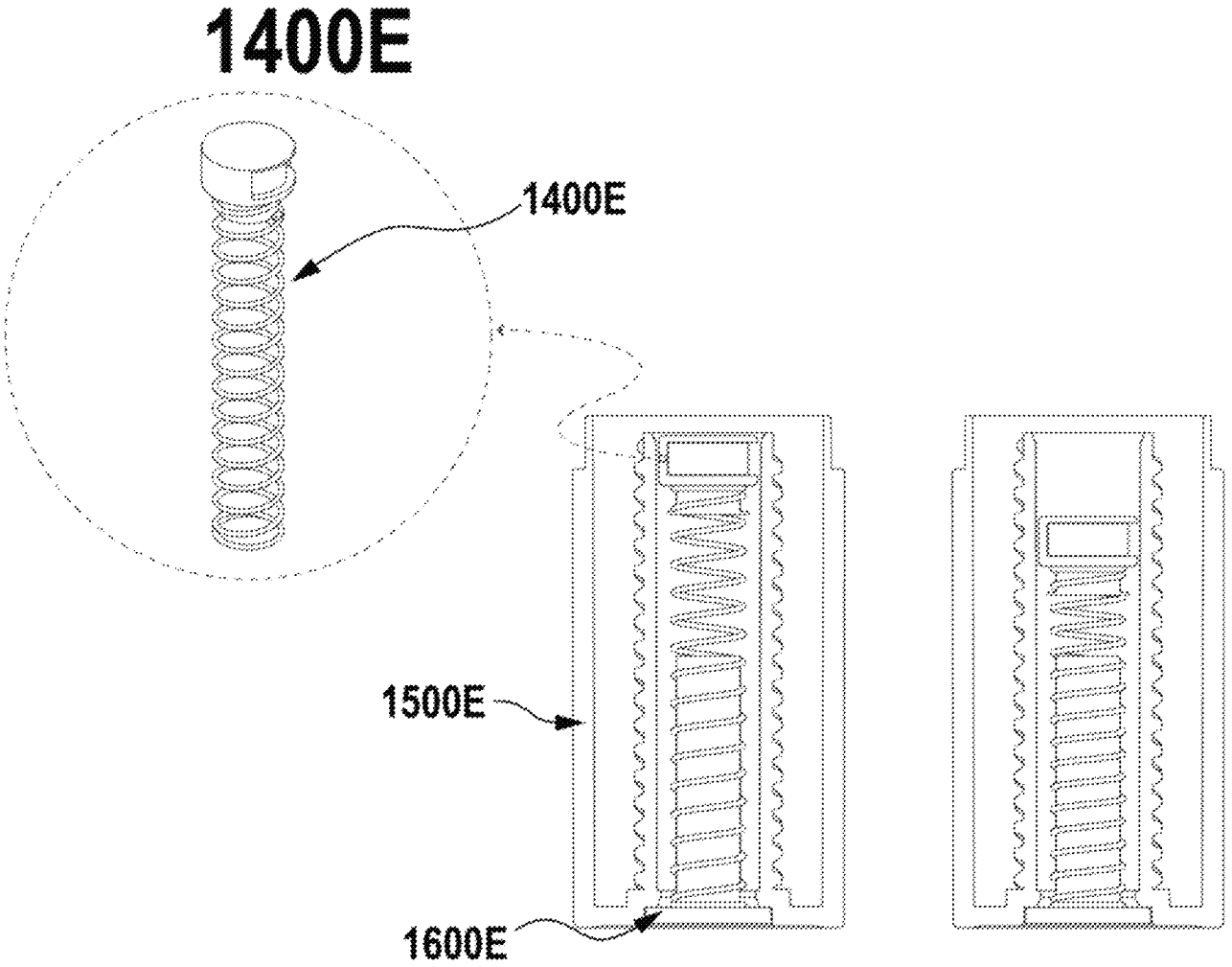
[FIG. 24]

【FIG. 25】
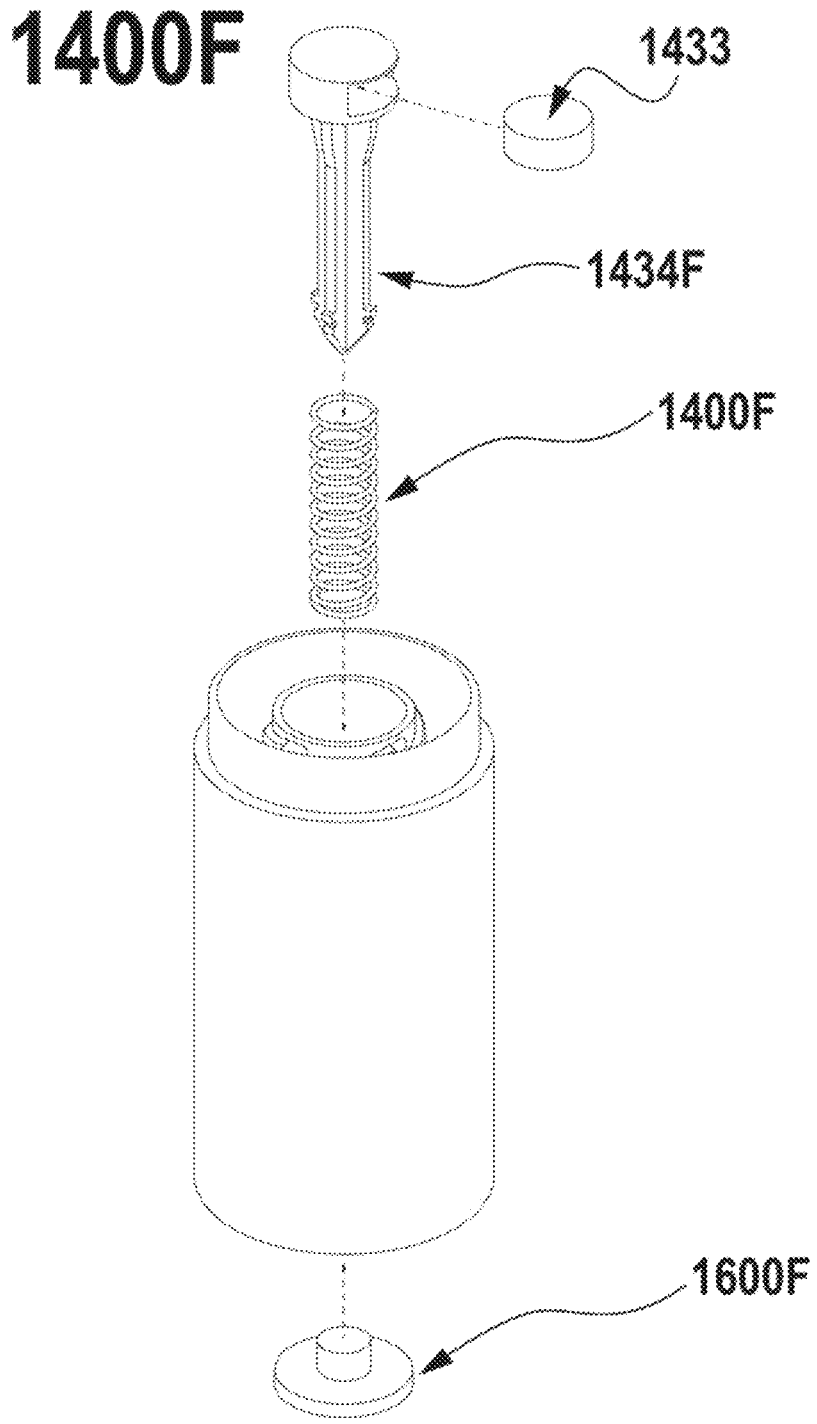

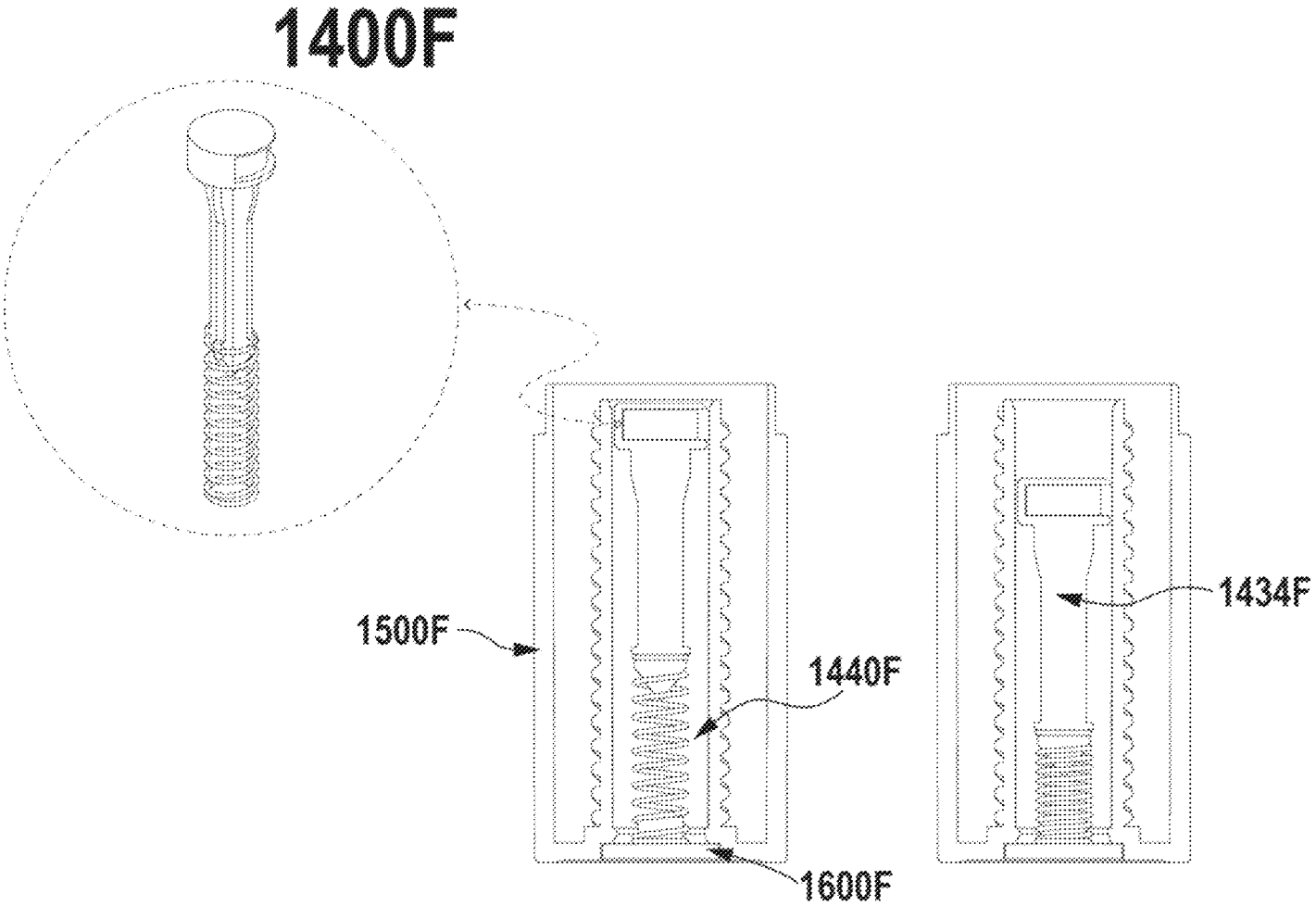
[FIG. 26]

【FIG. 27】
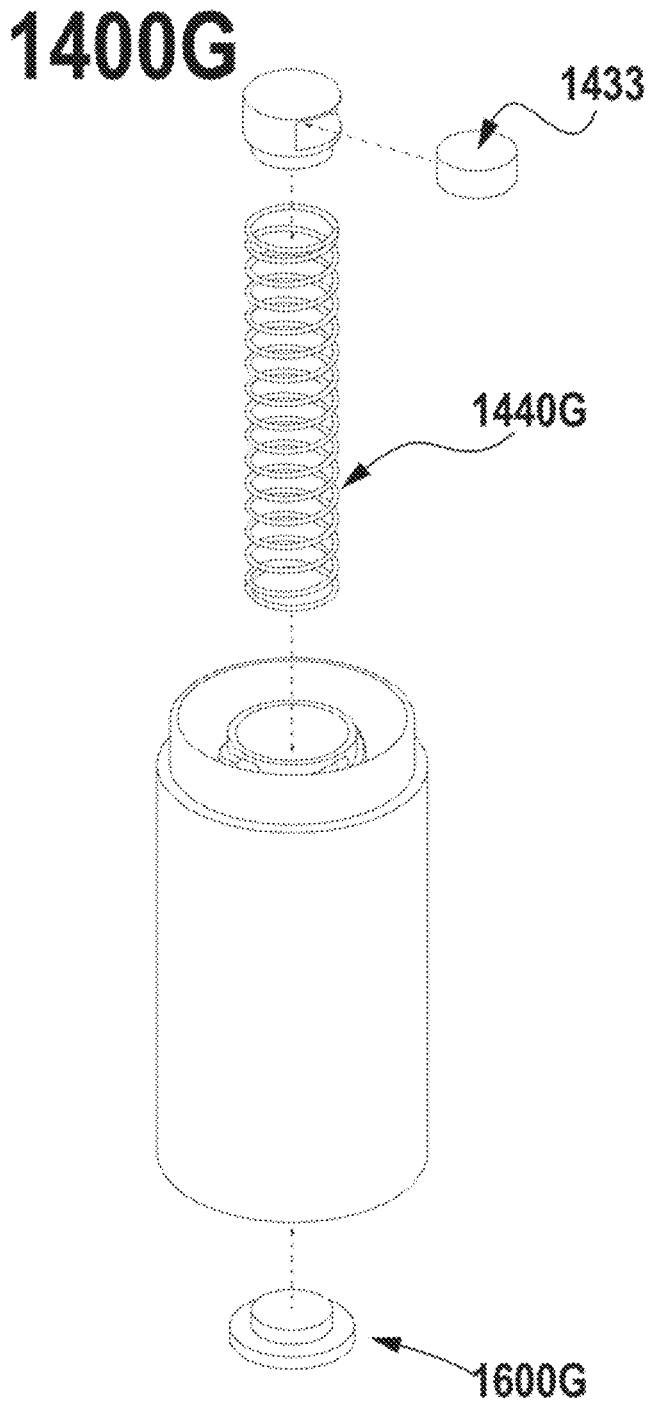

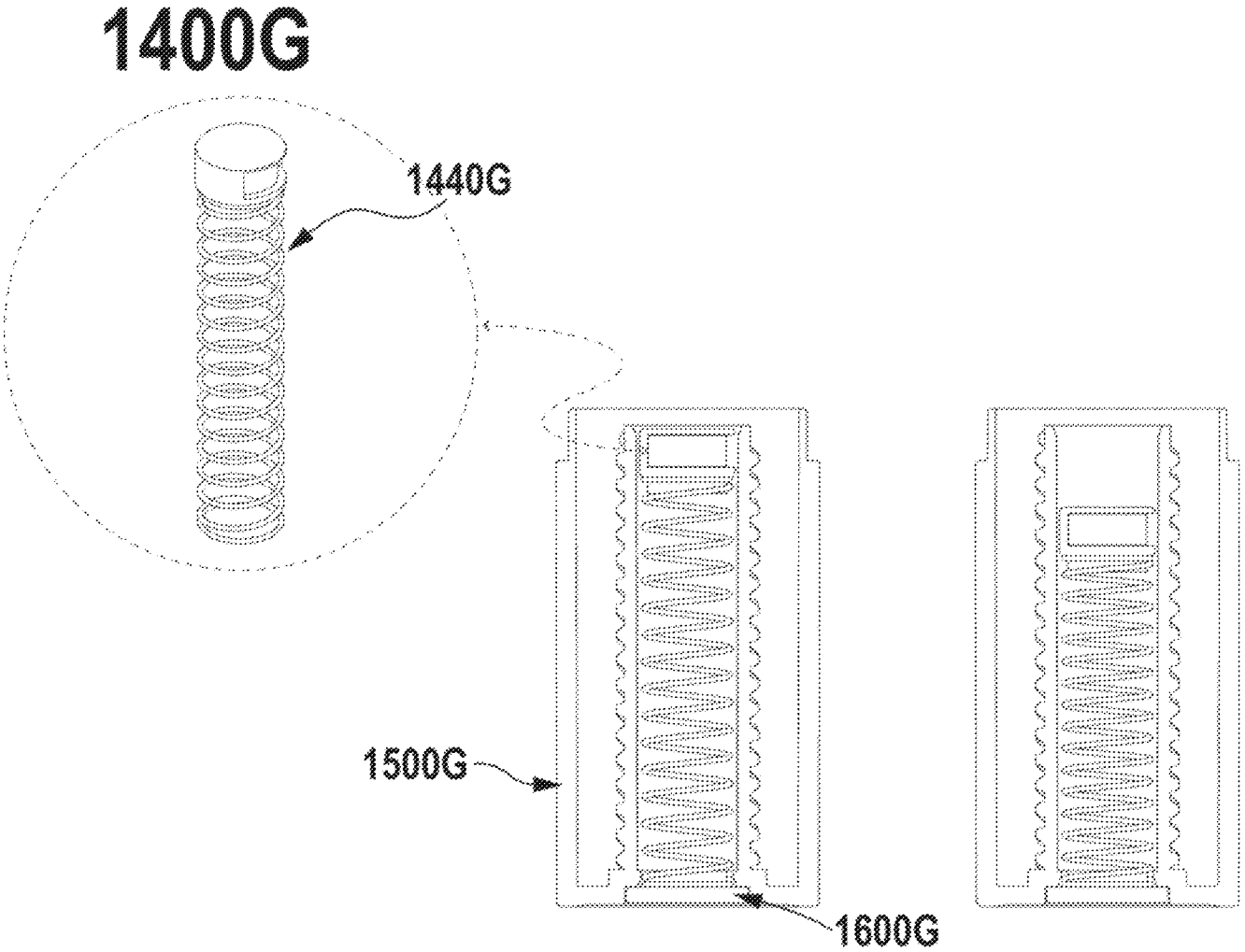
[FIG. 28]

【FIG. 29】
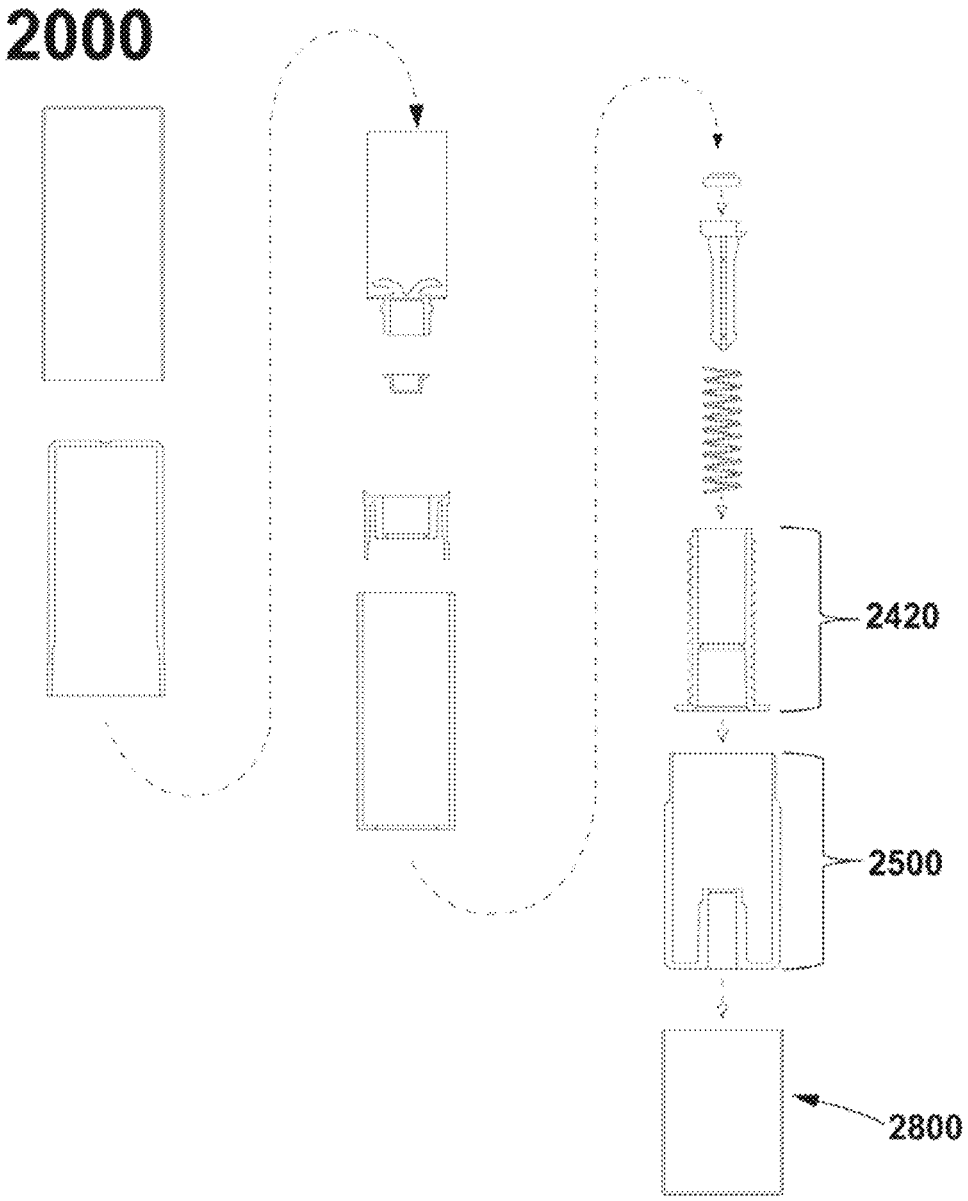

【FIG. 30】
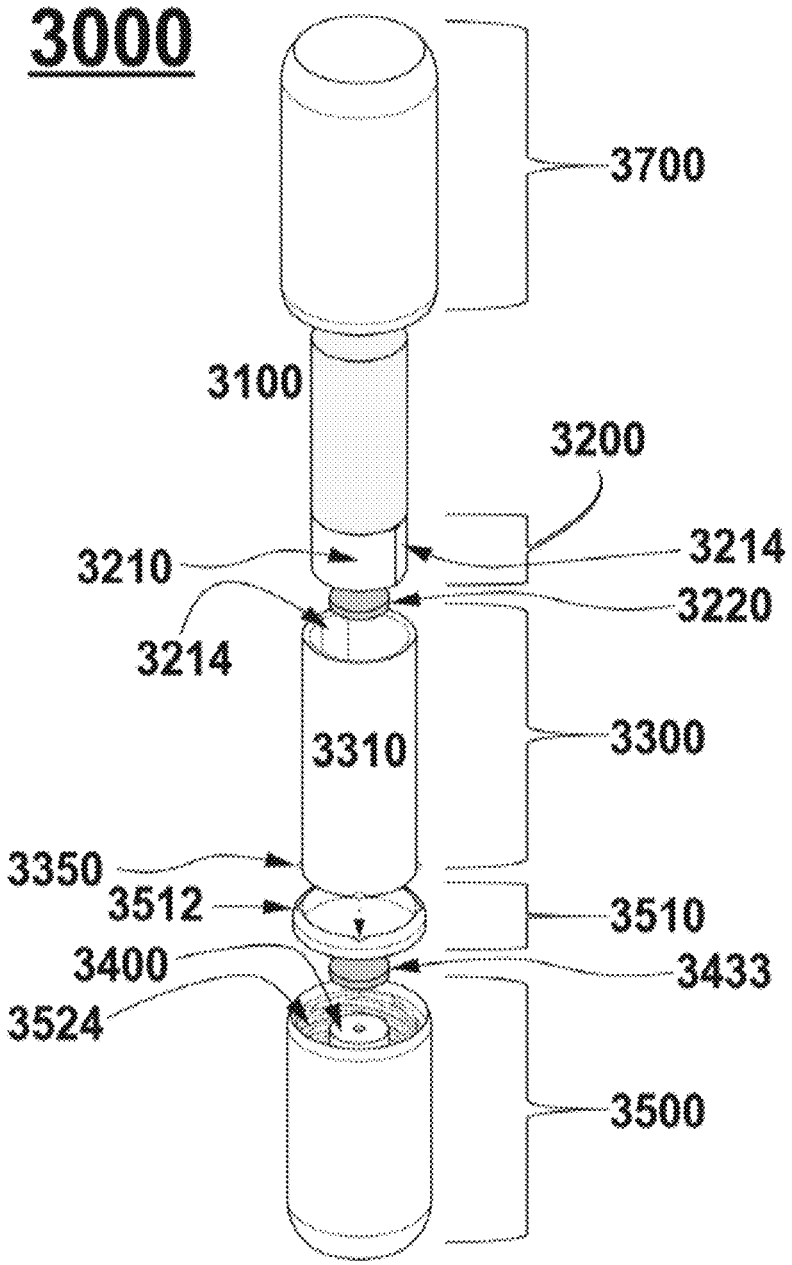

【FIG. 31】
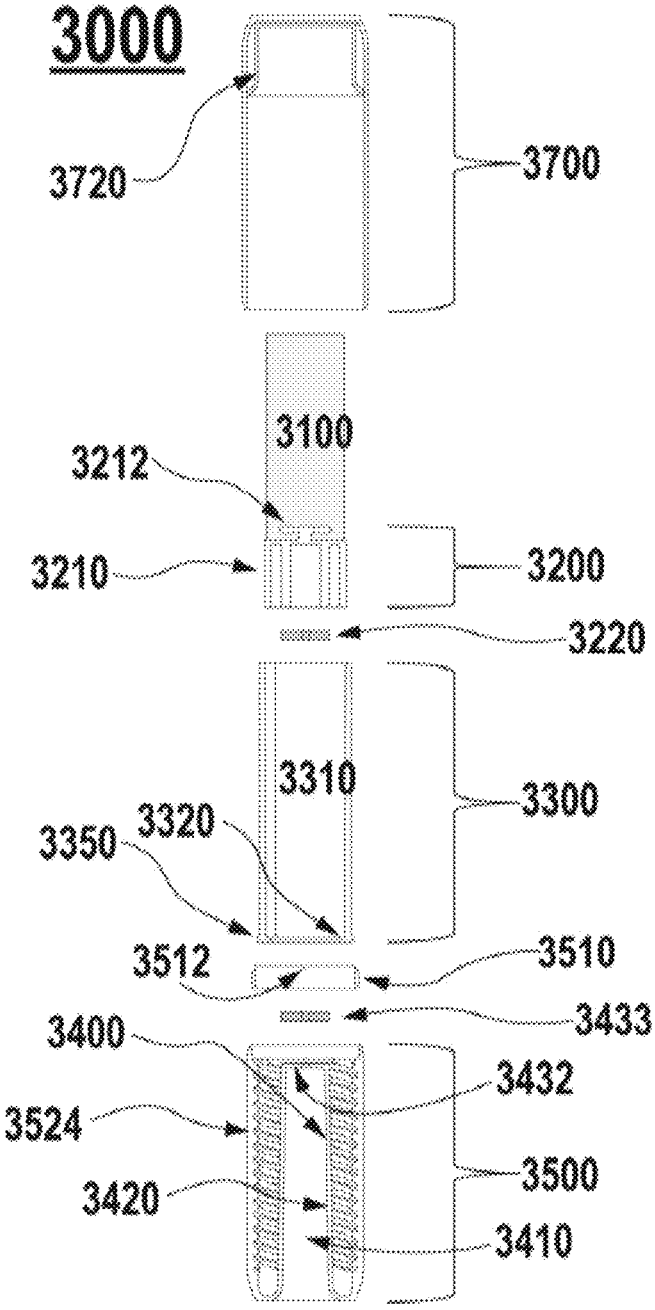

【FIG. 32】
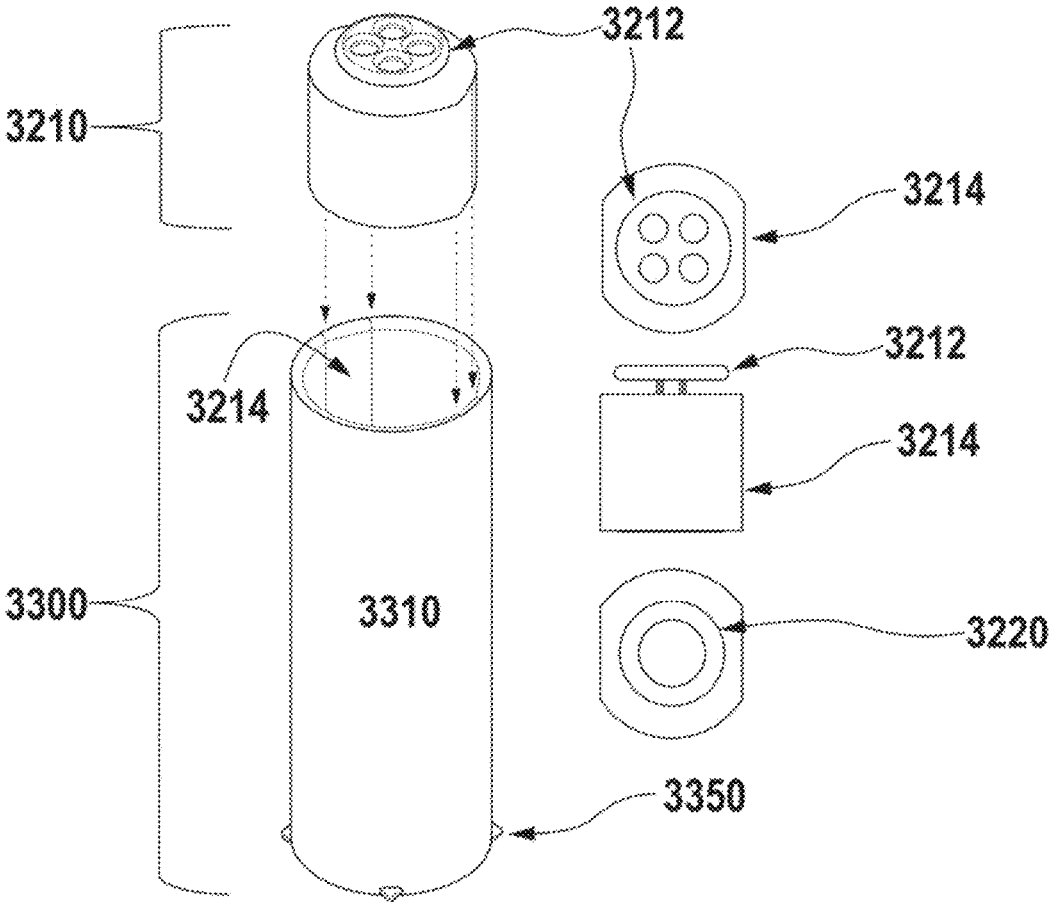

【FIG. 33】
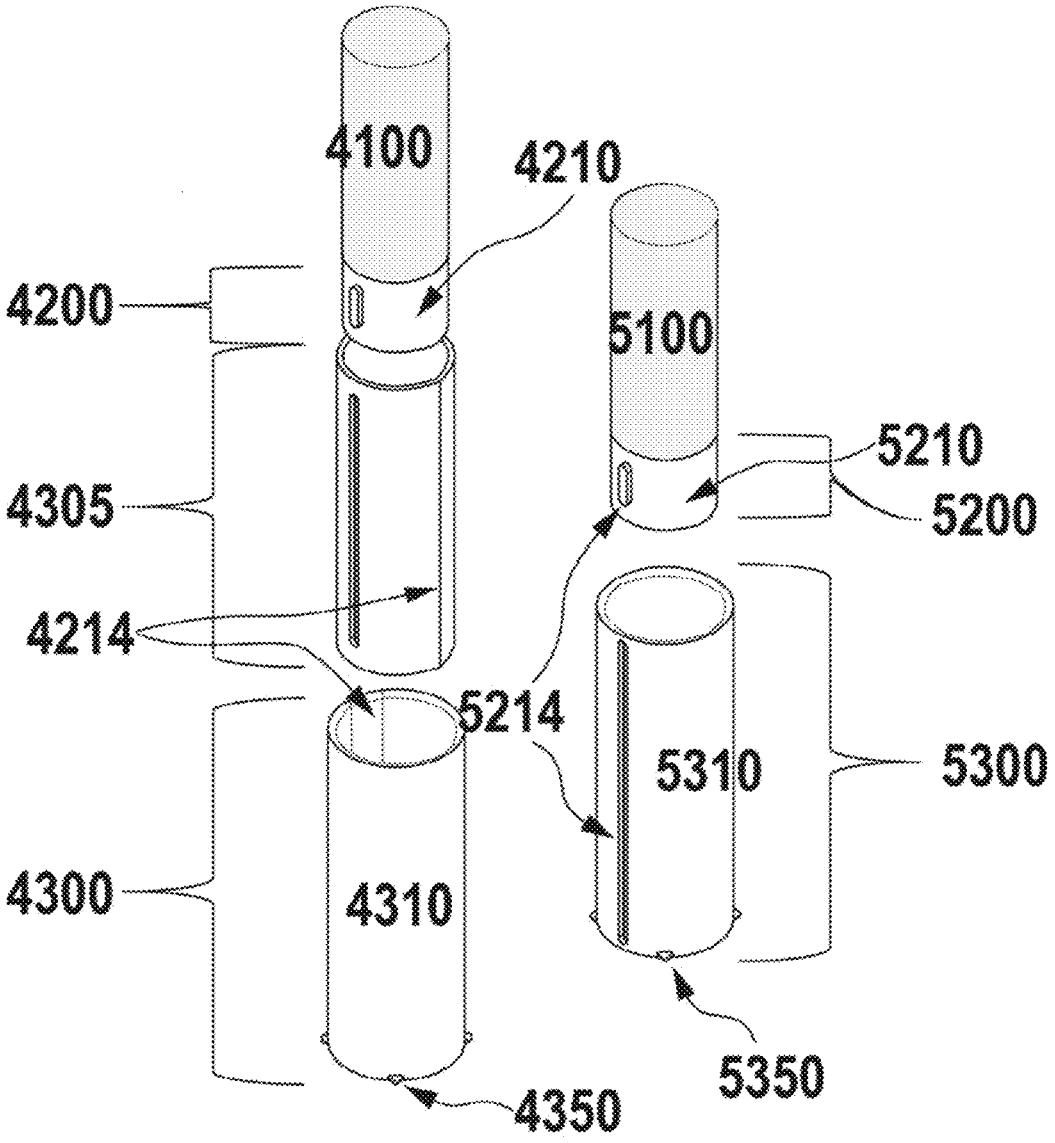

【FIG. 34】
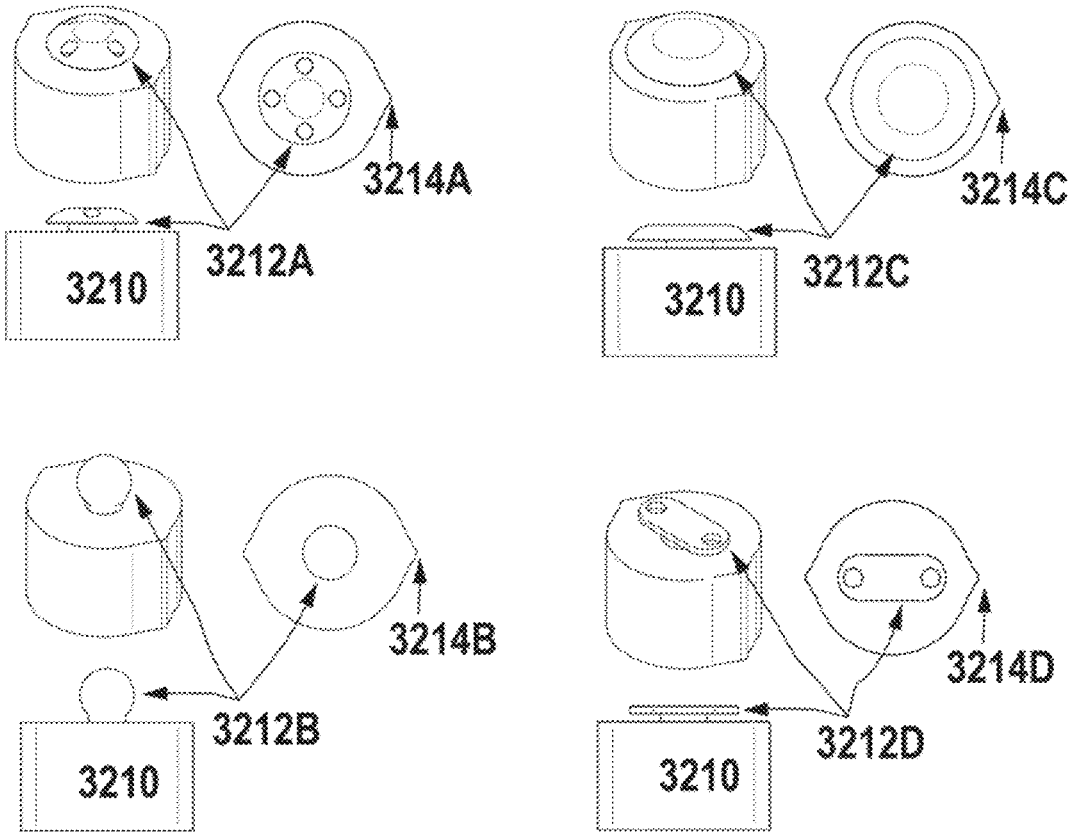

【FIG. 35】
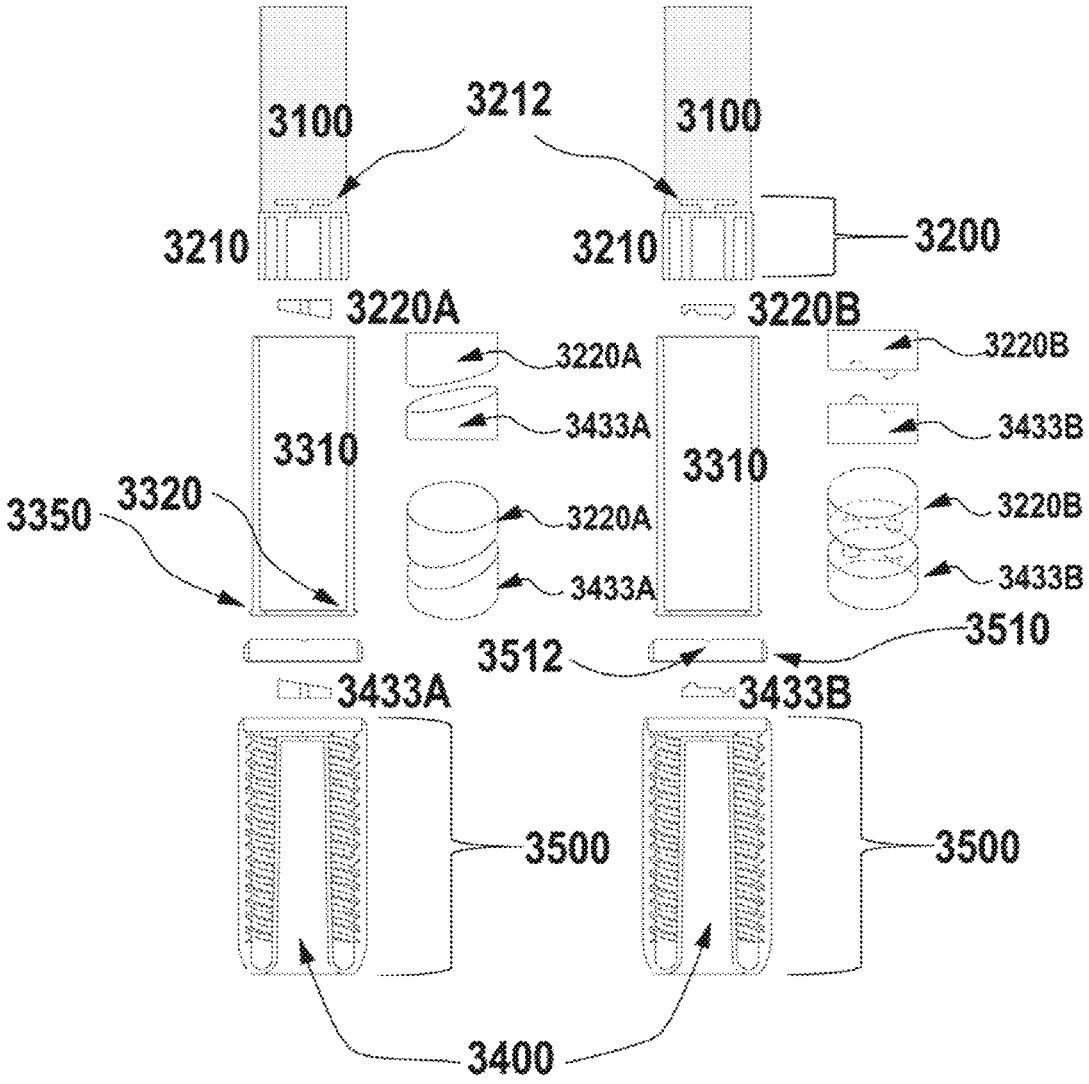

【FIG. 36】
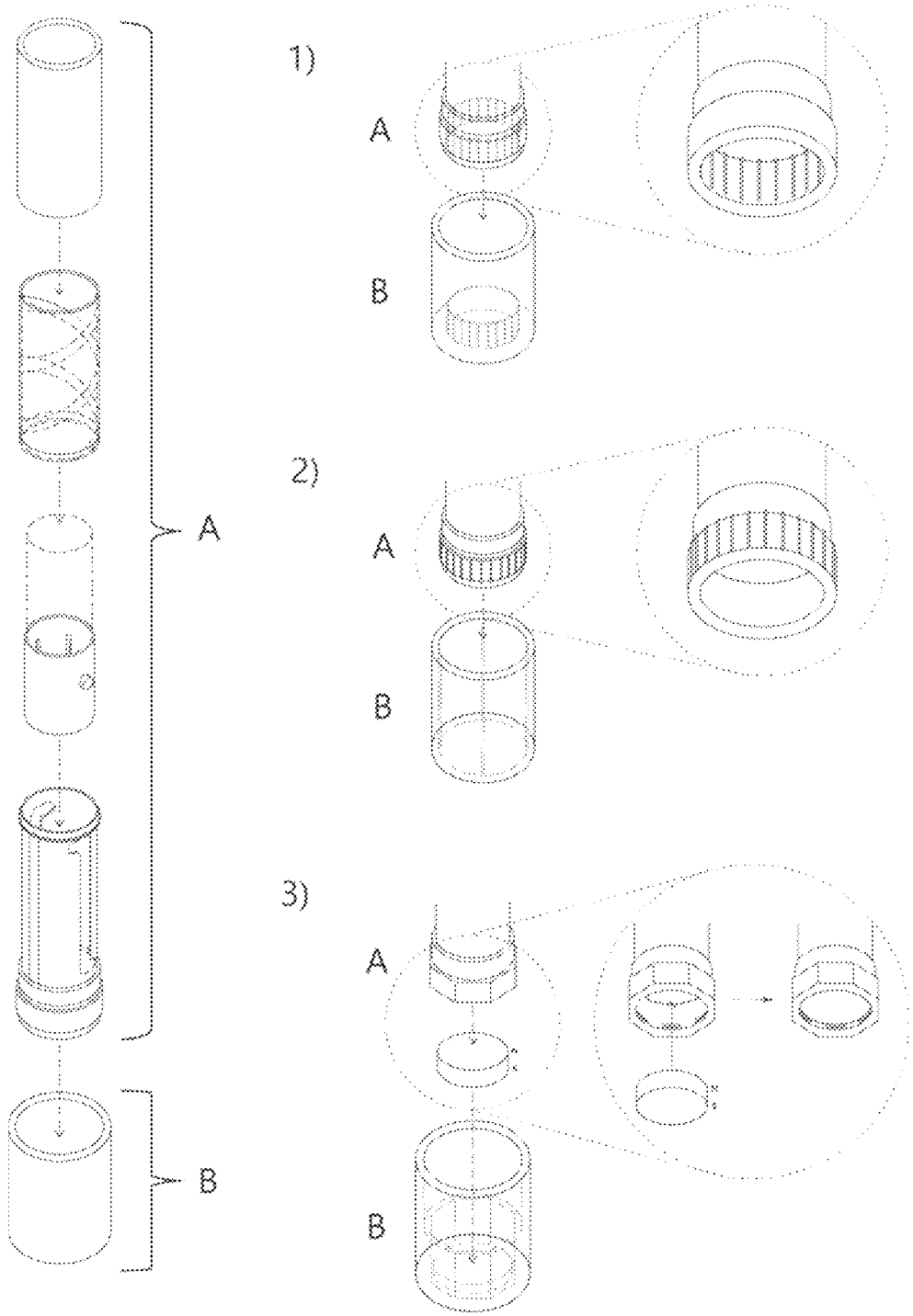

STICK-TYPE CONTAINER

TECHNICAL FIELD

This application is the National Phase of PCT International Application No. PCT/KR2022/013875, filed on Sep. 16, 2022, which claims priority under 35 U.S.C. § 119 (a) to Patent Application No. 10-2021-0141528, filed in the Republic of Korea on Oct. 22, 2021, and Patent Application No. 10-2022-0116345, filed in the Republic of Korea on Sep. 15, 2022, all of which are hereby expressly incorporated by reference into the present application.

The present invention relates to a stick-type container. More particularly, it relates to a stick-type container that is capable of adjusting exposure of the contents thereof through raising and lowering of an external elevation member surrounding the contents thereof and allows a user to easily refill the same.

BACKGROUND ART

Stick-type containers have advantages of being convenient to carry, minimizing contents, such as a cosmetic material, from spoiling by exposing only a portion of the contents to be used to the outside, and allowing a user to directly use the contents without taking the contents on his/her hand. Therefore, stick-type containers are filled with various products in a form of solid formulations as well as semi-solid formulations and are sold on the market. Stick-type sunscreen products in a form of semi-solid formulations, rather than conventional cream formulations, are gaining great popularity.

Conventional stick-type containers need to be improved for the following reasons.

1) The structure thereof is complex, and manufacture thereof is difficult due to separate parts for moving the position of contents such as a cosmetic material. Therefore, manufacturing costs thereof increase, and disassembly thereof is difficult, which is undesirable from an environmental perspective considering recycling.
2) When the conventional container is refilled with contents such as a cosmetic material, a user may get the cosmetic material on his/her hand or lose the same. When the conventional container is refilled with the cosmetic material, the cosmetic material may easily get on a user's hand or other objects, and thus may be lost or damaged. In the case of color cosmetics such as lipsticks, it is most important to cleanly refill the container with the color cosmetics while preventing the color cosmetics from contaminating surrounding objects.
3) It is not possible to know the refilling timing of contents such as a cosmetic material explicitly, and refilling itself is not easy. The conventional stick-type containers merely allow a user to roughly detect the amount of cosmetic material remaining therein. In addition, in order to refill the container with a cosmetic material, it is necessary to separate a coupling part from the cosmetic material and then to reassemble the coupling part to the cosmetic material. Due to this problem, most conventional lipsticks are sold on the market in a form that cannot be refilled.
4) It is difficult to use the cosmetic material to the end. In the case of stick-type products, the cosmetic material is placed vertically, and a separate fixing part needs to be provided at the bottom in order to support the cosmetic material. Since a portion of the cosmetic material must be insertedly disposed in the fixing part, a user may not use the portion of the cosmetic material disposed in the fixing part, which is a so-called "dead zone", to the end. In the case of conventional lipsticks, a user may directly apply the same to his/her lips during the initial period of use. Later on, however, the user needs to use a separate brush to use the remaining portion of the lipstick to the end.
5) It is necessary for a user to finely adjust pressure at which he/she uses the cosmetic material. Since the cosmetic material in a form of semi-solid formulations has low strength, the user needs to adjust pressure when he/she applies the cosmetic material to his/her face or the like. If a high pressure is applied to the contents when the user uses the same, the contents may be damaged. Therefore, careful use is the only solution.

In Patent Document 1, a cosmetic material is fixed in a vertical position, and the exposure degree of the cosmetic material is adjusted through raising and lowering of an external elevation member surrounding the cosmetic material. Patent Document 1 is characterized in that the cosmetic material does not rotate when the elevation member moves upward and downward.

In Patent Document 1, a separate inner container 220 having a thread is placed in a container in order to move the external elevation member. In addition, in order to prevent rotation, a guide tube 310, an extension portion 520, and a through-hole 420 are formed in a non-circular shape, thus making the structure complicated.

In Patent Document 1, since the cosmetic material is fixed in a position and a cover part 600 and an external container 210 are coupled to each other in a fixed form, it is necessary to continuously maintain an empty space between a cap and the top of the cosmetic material regardless of whether the cosmetic material is used.

Patent Document 1 does not appear to take into account refilling with a cosmetic material. The structure of Patent Document 1 has all of the problems with the related art in that a user must hold a cosmetic material with his/her hand and forcibly fit the cosmetic material into the container in order to refill the container with the cosmetic material.

In Patent Document 2, similar to Patent Document 1, a cosmetic material is fixed in a vertical position, and the exposure degree of the cosmetic material is adjusted through raising and lowering of an external elevation member surrounding the cosmetic material. The structure in which the cosmetic material does not rotate is also identical to that of Patent Document 1.

Also, in Patent Document 2, a guide tube 310 and a through-hole 420 are formed in a non-circular shape in order to prevent rotation of the cosmetic material, thus making the structure complicated.

Patent Document 3 relates to a cosmetic container in which a cosmetic material is fixed in a vertical position, and the exposure degree of the cosmetic material is adjusted through raising and lowering of an external elevation member surrounding the cosmetic material.

In Patent Documents 1 and 2, a screw is used to move the elevation member upward and downward. In Patent Document 3, O-rings are provided around the elevation member, and the elevation member is fixed by friction between the O-rings and a case body 10. According to Patent Document 3, the configuration is simple, but accuracy is low, and it is difficult to use the product for a long time due to hardening of the O-rings or the like.

In Patent Document 4, similar to Patent Document 3, an elevation member is configured to ascend and descend in a sliding manner without rotating. In addition thereto, in Patent Document 5, an elastic member and a notch 6 for fixing are additionally provided in a lower portion of the product.

All of Patent Documents 1 to 5 have a disadvantage of having to continuously maintain an empty space between the cap and the top of the cosmetic material regardless of whether the cosmetic material is used. In order to refill the container with a cosmetic material, a user must hold the cosmetic material with his/her hand and forcibly fit the cosmetic material into the container. That is, none of Patent Documents 1 to 5 appear to take into account refilling or to recognize the conventional problems regarding refilling.

In addition, in Patent Documents 1 to 5, a cosmetic material is placed vertically and a separate fixing part is provided under the cosmetic material in order to support the cosmetic material when the cosmetic material is exposed to the outside. Since a portion of the cosmetic material must be insertedly disposed in the fixing part, a user is not capable of directly using the portion of the cosmetic material disposed in such a "dead zone", and needs to use a brush or the like. Patent Documents 1 to 5 do not appear to recognize this as a problem.

Also, Patent Documents 1 to 5 do not appear to take into account cushioning technology for eliminating inconvenience in use when the user does not adjust pressure at which the cosmetic material is applied to the user.

FIG. 36 is a schematic view of a refillable product that is sold commercially. Referring to FIG. 36, a commercially available refillable container is largely divided into part A and part B. Part A is a refill part that is actually sold, and includes a structure for containing contents therein and moving the contents upward and downward. Part B is a body that supports part A, and corresponds to a substantially reusable case.

Part A includes a mechanical configuration that moves the contents upward and downward through rotation. In some cases, part A may include a mechanical configuration that ascends and descends in a vertical direction without rotating. In the left part of FIG. 36, an exploded perspective view is illustrated to show a mechanical configuration for moving contents upward and downward through rotation thereof. FIG. 36 also illustrates examples 1), 2), and 3) of a structure in which part A and part B are coupled to each other. Example 1) shows a structure in which a plurality of protruding portions formed on an inner peripheral portion of the lower end of part A and an inner column of part B are coupled to each other, example 2) shows a structure in which a plurality of protruding portions formed on an outer peripheral portion of the lower end of part A and a cylinder of part B are coupled to each other, and example 3) shows a structure in which a magnet provided on an inner peripheral portion of the lower end of part A and a polygonal outer peripheral portion of the lower end of part A are coupled to a metal or a magnet of part B and in a polygonal inner recess of part B. In the case of example 3), the two types of coupling are implemented simultaneously. However, the two types of coupling may be selectively implemented. In particular, the coupling structure using a magnet may be combined with the coupling structures of examples 1) and 2).

Specifically, among the commercially available products of "EGO STIC", "SHISEIDO", "HERMES", and "La Bouche Rouge", there are lipstick or multi-balm products configured to enable exchange of contents or refilling with contents. The products of "La Bouche Rouge" employ the structure corresponding to example 3) in FIG. 36, and the products of the other companies employ the structure corresponding to example 1) or 2) in FIG. 36, in which the refill part is fixed to the body in a fitting manner. Referring to part A shown in FIG. 36, all of the above products are configured such that a mechanical unit for moving contents such as lipstick upward and downward is added to the refill part. In other words, the body serves only as a simple cylindrical case, and substantial contents and all of the mechanical components for raising and lowering of the contents are provided in the refill part.

In the case of these products, since the refill part is a major part having complicated configuration, it is difficult to the recycle refill part, and manufacturing costs of the products increase.

All the components are located in the refill part, and the refill part and the case are coupled to each other only in a simple fitting manner or using a magnet. Therefore, when the refill part is coupled to the body, the refill part is not tightly attached to the body, and a clearance occurs between the refill part and the body. This clearance problem makes it difficult for a user to delicately apply lipstick to his/her desired area. Also, the above commercially available products do not take into account cushioning technology for eliminating inconvenience in use when the user does not adjust pressure at which the cosmetic material is applied to the user.

Korean Patent Registration No. 1944399 ("Patent Document 1")

Japanese Patent Registration No. 6212658 ("Patent Document 2")

Korean Utility Model Registration No. 0388883 ("Patent Document 3")

Korean Utility Model Registration No. 0493090 ("Patent Document 4")

Korean Utility Model Registration No. 0393383 ("Patent Document 5")

DISCLOSURE

Technical Problem

The present invention has been made to solve the above problems, and it is an object of the present invention to provide an improved stick-type container capable of 1) adjusting an exposure degree of a cosmetic material with a simple structure in which the cosmetic material does not ascend or descend, 2) allowing a user to refill the container with a cosmetic material without getting the cosmetic material on his/her hand or other objects, 3) allowing the user to know the refilling timing of cosmetic the material explicitly, 4) facilitating separation of the cosmetic material and refilling with the cosmetic material, 5) allowing the user to use the cosmetic material to the end without using a separate tool such as a brush, and 6) alleviating pressure at which the cosmetic material is applied to the user.

The stick-type container provided by the present invention is applicable to various products, such as medication or non-medication products, as well as cosmetic materials, so long as the products are in the form of semi-solid or solid formulations. The term "contents" used in the detailed description and claims of the present invention includes any of products in a form of semi-solid or solid formulations, such as cosmetic materials, medication products, and food.

Technical Solution

In order to solve the above problems, a stick-type container according to the present invention may include a contents holder configured to allow contents to be loaded therein, a body, an elevation member configured to ascend and descend to adjust exposure of the contents, and a holder support unit disposed in the body and configured to be detachably coupled to the contents holder to support the contents holder, wherein the holder support unit may include a holder support body including a hollow portion having an empty central portion, having a substantially cylindrical or polyhedral shape, and coupled to the body, a holder moving part disposed in the hollow portion and including an upper coupling portion located at a top thereof and detachably coupled to the contents holder, and an elastic support part disposed in the hollow portion, located under the upper coupling portion to support the upper coupling portion, and configured to be elastically deformed by pressure applied to the upper coupling portion. The elastic support part may be supported by at least one of a plug coupled to a lower end of the hollow portion, a protrusion protruding from the holder support body toward the hollow portion, or a protruding portion protruding from a lower portion of the body in an upward direction.

The holder support body and the body may be individual separated from each other or may be integrally connected to each other.

The upper coupling portion may be restricted in movement range in a downward direction and an upward direction, and the top surface of the upper coupling portion may not protrude beyond the top surface of the holder support body.

The holder moving part may further include a lower support portion extending from the lower end of the upper coupling portion so as to be disposed in the elastic support part, and the holder moving part may have a substantially T-shaped vertical section. The lower end of the lower support portion may have an arrowhead or wedge shape.

The elevation member may include a stopper configured to support the contents holder so that the contents holder is not discharged outside through the lower end of the elevation member.

Each of the body, the elevation member, and the contents holder may have a circular or polygonal cross-section, the contents holder and the holder support unit may be sized to be inserted into the elevation member, and the elevation member may be sized to be inserted into the body.

The elevation member may include an elevation body having a substantially cylindrical or prismatic shape and at least one first movement coupling portion protruding from the elevation body in the outward or inward direction of the elevation body or coupled to an outer surface or an inner surface of the elevation body so that the elevation member is supported by the body or the holder support unit.

The stick-type container may include a second movement coupling portion protruding from the inner surface of the body or the outer surface of the holder support unit or coupled to the inner surface of the body or the outer surface of the holder support unit so that the elevation member is supported by the body or the holder support unit.

Here, being "supported" means being fixed at a specific position while ascending and descending.

The elevation member may be raised and lowered by rotation of the body or the holder support unit.

As a first example of a non-limiting embodiment in which the elevation member is supported by the first movement coupling portion, the stick-type container may include a first screw formed on the inner surface of the body and a third movement coupling portion protruding from the outer surface of the elevation member, specifically, the outer surface of the lower end of the elevation body, and configured to be movable along the first screw.

As a second concrete example of the above non-limiting embodiment, the stick-type container may include a second screw formed on the outer surface of the holder support unit, specifically, the outer surface of the holder support body and a fourth movement coupling portion protruding from the inner surface of the elevation member, specifically, the lower end of the inner surface of the elevation body, and configured to be movable along the second screw.

The third movement coupling portion may be one or more in number and formed on the outer surface of the lower end of the elevation body, and the fourth movement coupling portion may be one or more in number and formed on the inner surface of the lower end of the elevation body.

The stick-type container may include a coupling ring in the form of a circular or polygonal ring, which includes a coupling recess formed in the upper end thereof so as to allow the third movement coupling portion to pass therethrough and is coupled to the upper end of the body. The coupling recess and the start point of the first screw may be disposed so as to be misaligned from each other. The first screw may have threads corresponding to the number of third movement coupling portions. Similarly, the second screw may have threads corresponding to the number of fourth movement coupling portions.

The stick-type container may include a ring-shaped coupling portion separately coupled to the upper end of the body. The coupling portion may be formed as a separate part, or may be integrally formed with the body.

The upper coupling portion and the contents holder may be detachably coupled to each other in at least one manner selected from the group consisting of a magnetic-coupling manner, a Velcro-coupling manner, a fitting-coupling manner, and an adhesive-coupling manner.

The stick-type container may include a magnet provided on at least one of the upper coupling portion or the lower surface of the contents holder. When magnets are provided on the two components, these magnets may be coupled to each other only at a predetermined angle.

The contents holder and the elevation member may be provided with an interlocking portion configured to allow the contents holder and the elevation member to move only in the longitudinal direction of the stick-type container without rotating relative to each other when coupled to each other.

The contents holder may be fitted into an upper portion of the elevation member, and when the contents holder and the elevation member are coupled to each other, the stopper may prevent the contents holder from being discharged outside through the lower end of the elevation member. In this case, the interlocking portion may also serve as the stopper.

The contents holder may include at least one of a holder configured to allow the contents to be loaded on an upper surface thereof, an inner fixing body including a side groove formed therein so as to allow the contents to be fitted thereinto, or an inner protruding portion configured to be fitted into the contents to fix the contents. The holder may include a protruding coupling portion disposed on an upper surface thereof so as to be inserted into the contents. In addition, since the protruding coupling portion is likely to directly contact the user's skin as the contents are used, the protruding coupling portion may include an elastic material. The protruding coupling portion is preferably formed in a thin wing shape to allow the user to use the contents to the end. However, the shape of the protruding coupling portion is not limited thereto, so long as the protruding coupling portion is capable of being inserted into the contents to fix the contents.

Meanwhile, since the outer peripheral portion of the contents holder moves along the inner peripheral portion of the elevation member, the contents holder may be further provided with an outer peripheral wing in order to seal the contents. The outer peripheral wing may be in the form of a thin and elastic band extending along the outer peripheral portion of the contents holder. In detail, the outer peripheral wing may be in the form of a band inclined upward and outward. The outer peripheral wing may be coupled using a separate member such as an O-ring.

The contents holder may further include a holder coupling part disposed under the holder and made of a metallic or magnetic material and a holder coupling ring configured to couple the holder coupling part to the holder. In detail, the outer peripheral wing may be provided on the holder coupling ring.

Meanwhile, the stick-type container may include a first cap formed in the shape of a tube having a closed top, accommodating at least a portion of the contents holder and at least a portion of the elevation member, and provided with at least one of a first coupling portion located on a lower portion of an inner surface thereof so as to be coupled to the body or a second coupling portion located on an upper portion of the inner surface thereof so as to be coupled to the elevation member. The first cap may extend farther downward so that at least a portion of the body is also accommodated in the tube.

The stick-type container may include a second cap formed in the shape of a tube having a closed end, accommodating at least a portion of the contents holder and at least a portion of the elevation member, and including a plurality of protruding portions formed in the tube in the longitudinal direction of the tube.

In the case of the second cap, an inner diameter of the tube having the close end is the smallest at an open entrance thereof and is the largest at the closed end thereof. As another example of the second cap, the inner diameter is the largest at the open entrance and is the smallest at the closed end. Alternatively, the inner diameter may be constant. Meanwhile, the inner diameter of the tube having the closed end may not be constant, but an inner diameter defined by the protruding portions may be constant.

The lower inner peripheral portion of the first cap may be larger than the outer peripheral portion of the body, and the first coupling portion and the second coupling portion may be coupled in at least one of a fitting-coupling manner or a magnetic-coupling manner.

The first cap and the elevation member may be coupled to each other to block the contents holder from the outside. In this case, the first cap may be smaller than the outer peripheral portion of the body.

Meanwhile, the body may be provided on the lower end thereof with a fixing portion formed to be detachably coupled to a separate support frame.

In addition, the present invention provides a refill cartridge including a contents holder configured to allow contents to be loaded therein and an elevation member formed in the shape of a hollow cylinder and configured to allow the contents holder to be disposed therein.

The contents holder may be fitted into an upper portion of the elevation member, and the contents holder may be prevented, by a stopper protruding from the lower end of the elevation member, from being discharged outside through the lower end of the elevation member.

The refill may cartridge be separately implemented from the stick-type container according to the present invention. When the contents provided in the stick-type container are completely used or are replaced, the existing contents holder in which the existing contents are contained and the elevation member in which the existing contents and the existing contents holder are disposed may be totally removed, and then a new integrated refill cartridge may be coupled.

The contents holder may include at least one of a holder configured to allow the contents to be loaded on an upper surface thereof, an inner fixing body including a side groove formed therein so as to allow the contents to be fitted thereinto, or an inner protruding portion configured to be fitted into the contents to fix the contents. The holder may include a protruding coupling portion disposed on an upper surface thereof so as to be inserted into the contents, and the protruding coupling portion may include an elastic material.

The contents holder may further include a holder coupling part disposed under the holder and made of a metallic or magnetic material and a holder coupling ring configured to couple the holder coupling part to the holder.

The elevation member may be formed in the shape of a hollow cylinder, the overall height of which is equal to or greater than the height of the contents holder in which the contents are loaded and which has an open top and a partially open bottom, and the stopper may be disposed on the lower surface of the elevation member so as to protrude from the peripheral portion of the elevation member.

In addition, the present invention may provide various combinations of the above solving means.

Advantageous Effects

Compared to the conventional stick-type container, the present invention has advantages of 1) adjusting exposure of contents with a simple structure in which the contents do not ascend or descend, 2) allowing a user to refill a container with contents without getting the contents on his/her hand, 3) allowing the user to know the refilling timing explicitly, 4) facilitating separation of the completely used contents and refilling with new contents, 5) allowing the user to use the contents to the end without using a separate tool such as a brush, and 6) alleviating pressure at which a cosmetic material is applied to the user.

DESCRIPTION OF DRAWINGS

FIG. 1 is an exploded perspective view of a first embodiment of a stick-type container according to the present invention.

FIG. 2 is an exploded view of the first embodiment of the stick-type container according to the present invention.

FIG. 3 is a cross-sectional view showing coupling examples of the first embodiment of the stick-type container according to the present invention.

FIGS. 4 and 5 are schematic views of a second cap according to the present invention.

FIG. 6 is a cross-sectional view showing cushioning action of the first embodiment of the stick-type container according to the present invention.

FIG. 7 is a view showing a holder, a holder coupling part, and a holder coupling ring according to the first embodiment of the stick-type container according to the present invention and a coupling example thereof.

FIGS. 8 to 14 are schematic views of various modifications of the holder and a protruding coupling portion according to the present invention.

FIG. 15 is a view showing other examples of an upper coupling portion and a lower support portion according to the first embodiment of the stick-type container according to the present invention.

FIGS. 16 to 28 are schematic views of various modifications of a holder support unit according to the present invention.

FIG. 29 is an exploded cross-sectional view of a second embodiment of the stick-type container according to the present invention.

FIG. 30 is an exploded perspective view of a third embodiment of the stick-type container according to the present invention.

FIG. 31 is an exploded cross-sectional view of the third embodiment of the stick-type container according to the present invention.

FIG. 32 is a schematic view of a holder and an elevation member in the third embodiment of the stick-type container according to the present invention.

FIG. 33 is an exploded perspective view of a contents holder and an elevation member in fourth and fifth embodiments of the stick-type container according to the present invention.

FIG. 34 is a schematic view of various modifications of a protruding coupling portion.

FIG. 35 is an exploded cross-sectional view of modifications of coupling between the contents holder and the holder support unit in the stick-type container according to the present invention.

FIG. 36 is a schematic view of a refillable product that is sold commercially.

BEST MODE

Now, preferred embodiments of the present invention will be described in detail with reference to the accompanying drawings such that the preferred embodiments of the present invention can be easily implemented by a person having ordinary skill in the art to which the present invention pertains. In describing the principle of operation of the preferred embodiments of the present invention in detail, however, a detailed description of known functions and configurations incorporated herein will be omitted when the same may obscure the subject matter of the present invention.

Wherever possible, the same reference numbers will be used throughout the drawings to refer to parts that perform similar functions or operations. Meanwhile, in the case in which one part is "connected" to another part in the following description of the present invention, not only may the one part be directly connected to the other part, but also, the one part may be indirectly connected to the other part via a further part. In addition, that a certain element is "included" means that other elements are not excluded, but may be further included unless mentioned otherwise.

Reference will now be made in detail to the preferred embodiments of the present invention, examples of which are illustrated in the accompanying drawings.

Hereinafter, embodiments according to the present invention will be described with reference to the drawings.

FIG. 1 is an exploded perspective view of a first embodiment of a stick-type container according to the present invention, FIG. 2 is an exploded view of the first embodiment of the stick-type container according to the present invention, FIG. 3 is a cross-sectional view showing coupling examples of the first embodiment of the stick-type container according to the present invention, FIGS. 4 and 5 are schematic views of a second cap according to the present invention, FIG. 6 is a cross-sectional view showing cushioning action of the first embodiment of the stick-type container according to the present invention, FIG. 7 is a view showing a holder, a holder coupling part, and a holder coupling ring according to the first embodiment of the stick-type container according to the present invention and a coupling example thereof, FIGS. 8 to 14 are schematic views of various modifications of the holder and a protruding coupling portion according to the present invention, and FIG. 15 is a view showing an upper coupling portion and a lower support portion according to the first embodiment of the stick-type container according to the present invention.

Referring to FIGS. 1 to 7, the first embodiment 1000 of the stick-type container according to the present invention includes a contents holder 1200 in which contents 1100 are loaded, a body 1500, an elevation member 1300 configured to ascend and descend to adjust exposure of the contents 1100, and a holder support unit 1400 disposed in the body 1500 and configured to be detachably coupled to the contents holder 1200 to support the contents holder 1200. The holder support unit 1400 includes a holder support body 1420, which includes a hollow portion 1410 having an empty central portion, has a substantially cylindrical shape, and is coupled to the body 1500, a holder moving part 1430, which is disposed in the hollow portion 1410 and includes an upper coupling portion 1432 located at the top thereof and detachably coupled to the contents holder 1200, and an elastic support part 1440, which is disposed in the hollow portion 1410, is located under the upper coupling portion 1432 to support the upper coupling portion 1432, and is configured to be elastically deformed by pressure applied to the upper coupling portion 1432. The elastic support part 1440 is supported by a protrusion 1422 protruding from the holder support body 1420 toward the hollow portion 1410. The holder support body 1420 includes a plurality of baffles 1425 protruding from an inner surface thereof in a vertical direction so as to guide movement of the holder moving part 1430.

The holder support body 1420 and the body 1500 are integrally connected to each other so as not to be individually separated from each other.

It is illustrated in FIGS. 3, 6, and 16 that the top surface of the upper coupling portion 1432 or 1432A does not protrude beyond the top surface of the holder support body 1420 or 1420A. In the case in which the top surface of the holder support body 1420 or 1420A is located at a higher position than the top surface of the upper coupling portion 1432 or 1432A, when the upper coupling portion 1432 or 1432A and a holder coupling part 1220 are coupled to each other, the contents holder 1200 substantially rotates to a certain degree along a second screw 1424 formed on the outer surface of the holder support body 1420 or 1420A, whereby the user may sense coupling through a sense of touch.

The upper coupling portion 1432 is restricted in movement range in a downward direction and an upward direction. This may be equally applied other embodiments. An example thereof may be clearly understood from FIG. 16, which illustrates one of various modifications of the holder support unit. The top surface of the upper coupling portion 1432A does not protrude outside the top surface of the holder support body 1420A. This is because the holder moving part is caught by the protrusion 1422A.

Meanwhile, when the user presses the contents 1100, the contents 1100 are moved by the elastic support part 1440, and thus are not greatly deformed.

The holder moving part 1430 further includes a lower support portion 1434 extending from the lower end of the upper coupling portion 1432 so as to be disposed in the elastic support part 1440. The holder moving part 1430 has a substantially T-shaped vertical section. The upper coupling portion 1432 is formed in a cylindrical shape having a large vertical section, and the lower support portion 1434 is in the form of two plates coupled perpendicularly to each other and has an arrowhead-shaped hook (not numbered) at the lower end thereof. The hook is caught by the protrusion 1422 and thus is restricted in movement. Referring to FIGS. 1 and 2, which illustrate the first embodiment 1000 of the stick-type container according to the present invention, the lower support portion 1434 is in the form of two plates coupled perpendicularly to each other, and is provided at the lower end thereof with a hook.

FIGS. 15 and 16 illustrate a case in which the lower support portion 1434A is formed in a cylindrical shape. FIGS. 15 and 16 illustrate a structure in which a magnet 1433 is fitted into a recess in the upper coupling portion 1432A through an upper surface of the upper coupling portion 1432A. FIGS. 1 and 2 illustrate a structure in which the magnet 1433 is fitted into the recess through a side surface of the upper coupling portion.

The elevation member 1300 may include a stopper 1320 to support the contents holder 1200 so that the contents holder 1200 is not discharged outside through the lower end of the elevation member 1300. In the first embodiment 1000 of the stick-type container according to the present invention, the stopper 1320, a first movement coupling portion 1330, and a fourth movement coupling portion 1340 are the same element.

Each of the body 1500, the elevation member 1300, and the contents holder 1200 has a circular cross-section. The contents holder 1200 and the holder support unit 1400 are sized to be inserted into the elevation member 1300, and the elevation member 1300 is sized to be inserted into the body 1500.

The elevation member 1300 may include an elevation body 1310 having a substantially cylindrical shape and at least one first movement coupling portion 1330 protruding from the elevation body 1310 toward the interior of the elevation body 1310 so that the elevation member 1300 is supported by the holder support unit 1400.

Here, being "supported" means being fixed at a specific position while ascending and descending.

The elevation member 1300 may be moved upward and downward by rotation of the body 1500 or the holder support unit 1400. The body 1500 and the holder support unit 1400 are integrally connected to each other so as not to be individually separated from each other. The elevation member 1300 is moved upward and downward by rotating the body 1500 in a state of holding the elevation body 1310.

As another example of the elevation member 1300, the elevation member 1300 may include a fourth movement coupling portion 1340 protruding from an inner surface thereof so as to be movable along the second screw 1424 formed on the outer surface of the holder support unit 1400, specifically, the outer surface of the holder support body 1420.

In the first embodiment 1000 of the stick-type container according to the present invention, the stopper 1320, the first movement coupling portion 1330, and the fourth movement coupling portion 1340 are the same element.

A coupling part 1510 having a ring shape may be additionally provided on the upper end of the body 1500 so as to be coupled thereto. The coupling part 1510 may be formed as a separate part, or may be integrally formed with the body 1500.

The upper coupling portion 1432 and the contents holder 1200 are detachably coupled to each other using magnetic force, and the magnet 1433 is provided in the upper coupling portion 1432.

The contents holder 1200 of the first embodiment 1000 of the stick-type container according to the present invention is illustrated in detail in FIG. 7. The leftmost view in FIG. 7 is a coupled perspective view of the contents holder 1200, and three schematic views on the right side thereof are a top view, a side view, and a bottom view from above to below. The rightmost view is an exploded perspective view.

The contents holder 1200 is inserted into the upper portion of the elevation member 1300, and when the contents holder 1200 and the elevation member 1300 are coupled to each other, the contents holder 1200 is not discharged outside through the lower portion of the elevation member 1300 by the stopper 1320.

The contents holder 1200 includes a holder 1210 formed to allow the contents 1100 to be loaded on the upper surface thereof, and a protruding coupling portion 1212 is disposed on the upper surface of the holder 1210 so as to be inserted into the contents 1100. In addition, since the protruding coupling portion 1212 is likely to directly contact the user's skin as the contents 1100 are used, the protruding coupling portion 1212 includes an elastic material. The protruding coupling portion 1212 is inserted into the contents 1100 to fix the contents 1100, and is formed in a thin wing shape to allow the user to use the contents 1100 to the end.

Since the outer peripheral portion of the contents holder 1200 moves relatively along the inner peripheral portion of the elevation member 1300, the contents holder 1200 is further provided with an outer peripheral wing 1232 in order to seal the contents 1100. The outer peripheral wing 1232 is in the form of a thin and elastic band extending along the outer peripheral portion of the contents holder 1200, specifically, the outer peripheral portion of a holder coupling ring 1230. In detail, the outer peripheral wing is in the form of a band inclined upward and outward. The outer peripheral wing 1232 may be substituted with a separate member such as an O-ring.

The contents holder 1200 further includes a holder coupling part 1220 disposed under the holder 1210 and made of a metallic or magnetic material and a holder coupling ring 1230 formed to couple the holder coupling part 1220 to the holder 1210. The outer peripheral wing 1232 is added to the holder coupling ring 1230.

Although the outer peripheral wing 1232 is illustrated in FIG. 7 as being coupled to the holder coupling ring 1230, the outer peripheral wing 1232 may be coupled to the holder 1210, or may be added to the two elements.

FIGS. 8 to 14 are schematic views of various modifications of the holder and the protruding coupling portion according to the present invention. In each of FIGS. 8 to 14, the upper-left view is a schematic view of the contents holder when viewed from above. The upper-right view illustrates viewing directions from which the contents holder is viewed, the seven middle views are schematic views of the contents holder when viewed from the respective viewing directions and a perspective view of the contents holder, and the lower view is a schematic view of the contents holder when viewed from below.

FIGS. 8 to 11 illustrate various modifications 1212A, 1212B, 1212C, and 1212D of the protruding coupling portion coupled to the contents 1100. The number of protruding coupling portions 1212A, 1212B, 1212C, and 1212D ranges from two to four, and the sizes and bent degrees thereof are varied.

FIGS. 12 and 13 illustrate structures in which no separate protruding coupling portion is formed and the contents 1100 are directly loaded in the contents holder. The contents are fixedly loaded in grooves formed in the periphery of an inner fixing body 1216A or 1216B having a cylindrical shape and/or in a space defined in the lower portion of the inner fixing body 1216B.

FIG. 14 illustrates a structure in which no separate protruding coupling portion is formed and the contents 1100 are directly loaded in the contents holder. The contents are fixed by inner protruding portions 1217 protruding from the contents holder.

There may be additionally provided a first cap 1700A, 1700B, or 1700C, which is in the form of a tube accommodating at least a portion of the contents holder 1200 and at least a portion of the elevation member 1300 and having a closed top. The first cap 1700A, 1700B, or 1700C is provided on a lower portion of the inner surface thereof with a first coupling portion 1710 formed to be coupled to the body 1500, is provided on an upper portion of the inner surface thereof with a second coupling portion 1720 formed to be coupled to the elevation member 1300, or is provided with both the first coupling portion 1710 and the second coupling portion 1720. The first cap 1700C is formed to further extend downward so as to also accommodate at least a portion of the body 1500.

The lower inner peripheral portion of the first cap 1700A is larger than the outer peripheral portion of the body 1500. The method of coupling the first coupling portion 1710 and the second coupling portion 1720 may be implemented through at least one of a fitting-coupling method or a magnetic-coupling method. The first cap 1700B is coupled to the elevation member 1300 to block the contents 1100 from the outside, and the lower inner peripheral portion of the second coupling portion 1720 is smaller than the outer peripheral portion of the body 1500. A second coupling portion 3720 shown in FIG. 31 is the same element as the second coupling portion 1720.

FIGS. 4 and 5 are schematic views of a second cap according to the present invention. FIG. 4 relates to a second cap 1700D, and FIG. 5 relates to a second cap 1700E. FIGS. 4 and 5 illustrate examples of the stick-type container in which a circular knob is added to a plug 1600. In the stick-type container 1000 shown in FIGS. 1, 2, 3, and 6, the plug 1600 serves only as a part to which a circular knob or the like is added, and is not involved in the function of the holder support unit 1400.

There may be additionally provided a second cap 1700D or 1700E, which is in the form of a tube accommodating at least a portion of the contents holder 1200 and at least a portion of the elevation member 1300 and having a closed end and includes a plurality of protruding portions 1730 formed in the tube in the longitudinal direction of the tube.

In the second cap 1700D or 1700E in the form of a tube having a closed end, the open entrance thereof has the smallest inner diameter, and the closed end thereof has the largest inner diameter. In another example, the second cap may be formed to have a constant cross-section.

FIG. 4(*a*) is an exploded perspective view of the second cap 1700D in the entire stick-type container. FIGS. 4(*b*) and 4(*c*) are transparent perspective views of the second cap 1700D in the states before and after being coupled to the entire container. FIGS. 4(*d*), 4(*e*), and 4(*f*) illustrate states in which the second cap 1700D is coupled, from which it can be seen that the entire container is inserted into the second cap 1700D deeper and deeper as the extent to which the contents are used increases.

FIG. 5(*a*) is an exploded perspective view of the second cap 1700E in the entire stick-type container. FIG. 5(*b*) is a perspective view of the second cap in the state before being coupled to the entire stick-type container, and FIGS. 5(*c*) and 5(*e*) are cross-sectional views of the second cap in the state after being coupled to the entire stick-type container. It can be seen that the entire container is inserted into the second cap 1700E deeper and deeper as the extent to which the contents are used increases. FIGS. 5(*d*) and 5(*f*) are horizontal sectional views of the second cap 1700E.

Each of the second caps 1700D and 1700E shown in FIGS. 4 and 5 is in the form of a tube having a closed end, the inner diameter of which is the smallest at the open entrance thereof (upper portion in the drawing) and is the largest at the closed end thereof (lower portion in the drawing). In this case, when the stick-type container is coupled to the second cap, the stick-type container is strongly coupled to the entrance of the second cap, but a clearance may occur as the stick-type container is further coupled due to the gradually increasing inner diameter of the second cap.

In order to solve this problem, the second cap 1700D or 1700E is additionally provided therein with a protruding portion 1730. Referring to FIG. 4, the protruding portion 1730 includes a pillar 1732 extending vertically and a horizontal ring 1734. The pillar 1732 is fixed in close contact with the inner surface of the second cap 1700D. In FIG. 4, four horizontal rings 1734 are illustrated. The horizontal rings 1734 are formed in the shape of a thin donut, and have uniform inner diameters. That is, the outer diameters of the horizontal rings 1734 increase from the gradually uppermost horizontal ring to the lowermost horizontal ring in FIG. 4, but the inner diameters thereof are uniform. Accordingly, when the stick-type container is coupled to the second cap 1700D, constant fixing force is maintained at any position, and coupling to the cap is easily implemented. In addition, since the end of the second cap 1700D has a relatively large area, the stick-type container may be stably stored in a state of standing vertically, as shown in FIG. 4.

Referring to FIG. 5, the protruding portion 1730 is composed only of pillars 1732 extending vertically. The pillars 1732 are fixed in close contact with the inner surface of the second cap 1700E. In this case, the thickness of each of the pillars gradually increases from the top thereof to the bottom thereof in FIG. 5, and accordingly, the inner diameter defined by the pillars 1732 is maintained to be constant. Accordingly, as described above with reference to FIG. 4, when the stick-type container is coupled to the second cap 1700E, constant fixing force is maintained at any position, and coupling to the cap is easily implemented. Referring to FIG. 5(*f*), which is a horizontal sectional view showing the upper portions of the pillars, the pillars are cut from each other, and referring to FIG. 5(*d*), which is a horizontal sectional view showing the lower portions of the pillars, only the outer surfaces of the pillars are cut from each other. Accordingly, when the protruding portion 1730 is inserted into the second cap 1700E, the protruding portion 1730 is fully spread in the second cap 1700E.

The protruding portion 1730 is preferably made of thermoplastic resin, rather than metal, in order to achieve close contact and fixation. Specifically, PE or PP may be used, or a rubber-containing elastic material other than thermoplastic resin may also be used. The outer peripheral portions of the first caps 1700A, 1700B, and 1700C and the second caps 1700D and 1700E are preferably made of metal having high strength and light weight. Resin having high strength (ABS, PET, or PC) may also be used.

FIG. 3 is a cross-sectional view showing coupling examples of the first embodiment of the stick-type container according to the present invention. FIG. 3 illustrates all of the three first caps 1700A, 1700B, and 1700C. Meanwhile, illustration of the elastic support part 1440 is omitted in FIG. 3 for convenience of description.

FIGS. 3(*a*), 3(*b*), 3(*c*), and 3(*d*) relate to the cap 1700A. In the initial state ((a)), when the cap 1700A is removed ((b)) and the elevation member 1300 is moved downward ((c)), the contents 1100 are exposed. As the contents 1100 are continuously used, the amount of contents 1100 decreases, and accordingly, the elevation member 1300 is moved farther downward. FIG. 3(*d*) shows a state in which the cap 1700A is coupled in the state in which the elevation member 1300 is moved to be located farther upward than the contents 1100 after use of the contents 1100. If the cap 1700B is used in the state shown in FIG. 3(*d*), the user may visually recognize reduction in the length of the entire container, as shown in FIG. 3(*e*), and thus may easily know the refilling timing of the contents 1100. As shown in FIG. 3(*f*), when the remaining amount of contents 1100 is small, the user is capable of using the contents 1100 to the end without using a separate brush since the protruding coupling portion 1212 is in the form of a wing made of an elastic material. As shown in FIG. 3(*g*), when the contents 1100 are completely used and then the elevation member 1300 is moved upward to the end through rotation thereof, the contents holder 1200 is naturally separated from the upper coupling portion 1432, particularly, the magnet 1433, by the raising force and the stopper 1320. When the container is refilled with the contents 1100, the contents 1100 do not contact the user's hand since the contents 1100 are accommodated in the elevation member 1300. Refilling is performed in reverse order. That is, when the elevation member 1300 accommodating the contents 1100 is coupled to the holder support unit 1400, the contents holder 1200 is naturally coupled to the upper coupling portion 1432.

Meanwhile, the body 1500 may be provided on the lower end thereof with a fixing portion (not shown) formed to be detachably coupled to a separate support frame. This coupling may be implemented through the plug 1600.

FIG. 6 is a cross-sectional view showing cushioning action of the first embodiment 1000 of the stick-type container according to the present invention.

FIG. 6(*a*) illustrates a state in which no force is applied to the contents 1100. As shown in FIG. 6(*b*), when an external force F is applied to the contents 1100, the contents 1100 are pushed downward by the elastic support part 1440. Since the elevation member 1300, particularly, the elevation body 1310, is supported by the second screw 1424 and the fourth movement coupling portion 1340, the elevation body 1310 is not changed in position by the external force F. Although the elastic support part 1440 exerts pushing force on the upper coupling portion 1432, the upper coupling portion 1432 does not move beyond a predetermined position due to the protrusion 1422 of the holder support unit 1400 and the hook (not numbered) of the lower support portion 1434.

If the user applies a low pressure to the contents 1100 while applying the contents 1100 to his/her skin, the contents 1100 are maintained in a fixed state. When the user strongly brings the contents 1100 into contact with his/her skin, the contents 1100 are pushed elastically, and accordingly, the user may apply the contents 1100 to his/her skin while having a feeling of smoothness. In addition, it is possible to prevent the contents 1100 from being damaged by high pressure.

FIG. 15 illustrates the holder moving part 1430A structured such that the magnet 1433 is fitted into the upper coupling portion 1432A through an upper surface of the upper coupling portion 1432A. FIGS. 1 and 2 illustrate a structure in which the magnet 1433 is fitted into the upper coupling portion 1432 through a side surface of the upper coupling portion 1432.

FIGS. 16 to 28 are schematic views of various modifications of the holder support unit according to the present invention.

FIG. 16 illustrates a case in which the lower support portion 1434A has a cylindrical shape. In addition, FIG. 16 illustrates a structure in which the magnet is fitted into the recess in the upper coupling portion through an upper surface of the upper coupling portion.

Referring to FIGS. 17 and 18, the holder support unit 1400B is structured such that the magnet 1433 is fitted in a horizontal direction, and the elastic support part 1440B is supported by the plug 1600B.

Referring to FIGS. 19, 20, 23, 24, 25, 26, 27, and 28, the elastic support part 1440C, 1440E, 1440F, or 1440G of the holder support unit 1400C, 1400E, 1400F, or 1400G is disposed in the plug 1600C, or is supported by the plug 1600E, 1600F, or 1600G. The lower support portion 1434C may be restricted in movement by the plug 1600C. The holder support units 1400E and 1400G have no separate lower support portion.

In the holder support unit 1400D shown in FIGS. 21 and 22, the elastic support part 1440D may be supported by the plug 1600D, and the lower support portion 1434D may be restricted in movement by the plug 1600D.

FIG. 29 is an exploded cross-sectional view of a second embodiment 2000 of the stick-type container according to the present invention. Only a difference from the first embodiment 1000 will be described. The second embodiment 2000 is configured such that a body 2500 and a holder support body 2420 are separable from each other. The holder support body 2420 is provided therein with a protrusion so as to be fitted into the body 2500. In addition, the body 2500 includes a protruding portion (not numbered) formed at the center thereof so as to be fitted into the holder support body 2420. In addition, a lower case 2800 made of metal may be provided on the outer surface of the lower portion of the body.

FIG. 30 is an exploded perspective view of a third embodiment of the stick-type container according to the present invention, FIG. 31 is an exploded cross-sectional view of the third embodiment of the stick-type container according to the present invention, and FIG. 32 is a schematic view of a holder and an elevation member in the third embodiment of the stick-type container according to the present invention.

The stick-type container 3000 includes a contents holder 3200 in which contents 3100 are loaded, a body 3500, an elevation member 3300 configured to ascend and descend to adjust exposure of the contents 3200, and a holder support unit 3400 including a lower portion disposed in the body 3500 and an upper portion detachably coupled to the contents holder 3200 to support the contents holder 3200. The elevation member 3300 includes a stopper 3320 to support the contents holder 3200 so that the contents holder 3200 is not discharged outside through the lower end of the elevation member 3300.

Each of the body 3500, the elevation member 3300, and the contents holder 3200 has a circular cross-section. The contents holder 3200 and the holder support unit 3400 are inserted into the elevation member 3300. The elevation member 3300 is inserted into the body 3500.

The third embodiment 3000 of the stick-type container according to the present invention is provided with the body 3500, a first screw 3524 formed on the inner surface of the body 3500, and the holder support unit 3400 disposed in the body 3500 and including an upper portion detachably coupled to the contents holder 3200 to support the contents holder 3200. A magnet 3433 is coupled to the upper portion of the holder support unit 3400.

A coupling ring 3510 including four coupling recesses 3512 formed therein is coupled to the upper surface of the body 3500. A holder coupling part 3220 having a magnetic property is coupled to the lower surface of the contents holder 3200 in which the contents 3100 are loaded. In this state, the contents holder 3200 is inserted into the elevation member 3300 through the upper portion of the elevation member 3300. In the state in which the contents holder 3200 is disposed in the elevation member 3300, third movement coupling portions 3350 of the elevation member 3300 are engaged with the first screw 3524 through the coupling recesses 3512. In this case, the holder coupling part 3220 having a magnetic property and coupled to the lower surface of a holder 3210 is coupled to the magnet 3433 coupled to the upper surface of the holder support unit 3400, whereby the contents holder 3200 is fixed to the holder support unit 3400.

The stopper 3320, which partially protrudes from the lower surface of the elevation member 3300 toward the interior of the elevation member 3300, prevents the contents holder 3200 inserted into the elevation member 3300 through the upper portion of the elevation member 3300 from being discharged outside through the lower portion of the elevation member 3300. In addition, when the elevation member 3300 is discharged outside the body 3500 for refilling, contents the holder 3200 is discharged together with the elevation member 3300 by the stopper 3320.

When the first cap 3700 is coupled, the inside of the container is blocked from the outside. After the first cap 3700 is removed, when the elevation member 3300 is rotated relative to the body 3500, the elevation member 3300 descends in the longitudinal direction of the stick-type container 3000, thereby exposing the contents 3100 to the outside. That the elevation member 3300 descends means that the elevation member 3300 enters the body 3500.

The elevation member 3300 includes an elevation body 3310 having a substantially cylindrical shape and at least one third movement coupling portion 3350 protruding outward from the elevation body 3310 so that the elevation member 3310 is supported by the body 3500.

The elevation member and the body are illustrated in FIGS. 30 to 35 as being coupled to each other using the first screw 3524 and the third movement coupling portion 3350, 4350, or 5350.

The elevation member 3300 may be raised and lowered by rotation of the body 3500.

In the specification of the present invention, raising and lowering of the elevation member means movement thereof in the longitudinal direction of the stick-type container. In addition, raising and lowering of the elevation member includes not only raising and lowering thereof with rotation thereof relative to the body but also raising and lowering thereof without rotation thereof relative to the body.

Since the positions of the first screw 3524 and the third movement coupling portion 3350 are relative to each other, the positions of these corresponding components may be interchanged. That is, if the third movement coupling portion 3350 provided at the elevation member 3300 is provided at the body 3500, the first screw 3524 may be provided at the elevation member 3300.

The structure in which the elevation member 3300 is fixed to and is raised and lowered relative to the body 3500 or the holder support unit 3400 using the screw may be modified in various other structures using, for example, a groove and slide, an elastic protrusion, an O-ring, or combinations of two or more thereof.

One or more third movement coupling portions 3350 may be provided on the outer side of the lower end of the elevation member 3300. Four third movement coupling portions are illustrated in FIGS. 30 to 33 as being disposed symmetrically to each other. It is desirable for the number of third movement coupling portions not to exceed four in consideration of processing of a thread or the like.

There may be additionally provided a coupling ring 3510, which is in the form of a circular ring, including coupling recesses 3512 formed in the upper end thereof so as to allow the third movement coupling portions 3350 to pass therethrough and coupled to the upper end of the body 3500. The coupling recesses 3512 and the start point of the first screw 3524 may be disposed so as to be misaligned from each other. The third movement coupling portions 3350 fitted through the coupling recesses 3512 need to be rotated to a certain degree in order to be engaged with the first screw 3524 formed on the inner surface of the body 3500. This may prevent the third movement coupling portions 3350 moved to the top of the first screw 3524 from being immediately separated from the first screw 3524 through the coupling recesses 3512.

The third movement coupling portion 3350 may have a width that gradually increases from the outer end thereof to the inner end thereof. This may facilitate passing through the coupling recess 3512 and enhance engagement with the first screw 3524.

If the magnet 3433 or a first magnet 3220A or 3220B and a second magnet 3433A or 3433B, which will be described later, are additionally provided and these magnets have a sufficient amount of coupling force, the third movement coupling portions 3350 are not immediately separated from the first screw 3524. In this case, the coupling recesses 3512 and the start point of the first screw 3524 may be disposed so as not to be misaligned from each other.

Meanwhile, the screw may be configured according to the number of third movement coupling portions 3350. When the number of third movement coupling portions 3350 is one, a first screw 3524 having one thread may be provided on the body 3500, and when the number of third movement coupling portions 3350 is two, a first screw 3524 having two threads may be provided on the body 3500. Also, when a plurality of third movement coupling portions 3350 is provided, a plurality of coupling recesses 3512 may be provided in the same number as the third movement coupling portions 3350.

In another example, when at least two third movement coupling portions (not shown) are disposed at the same position or in the same phase in the longitudinal direction of the stick-type container, the third movement coupling portions may be disposed so as to be spaced apart from each other at an interval equivalent to multiples of the pitch of the screw, which is a moving distance per revolution of the screw. In this case, there is no need to increase the number of threads and the number of coupling recesses according to the number of third movement coupling portions.

The holder support unit 3400 may include a holder support body 3420, which includes a hollow portion 3410 having an empty central portion, has a substantially cylindrical shape, and is coupled to the body 3500, and an upper coupling portion 3432, which is disposed in the hollow portion 3410 and is detachably coupled to the contents holder 3200.

The upper surface of the holder support unit 3400 and the lower surface of the contents holder 3200 may be detachably coupled to each other in at least one manner selected from the group consisting of a magnetic-coupling manner, a Velcro-coupling manner, a fitting-coupling manner, and an adhesive-coupling manner. Among the above coupling manners, the magnetic-coupling manner is preferable. Magnets 3220 and 3433 may be disposed both on the upper surface of the holder support unit 3400 and on the lower surface of the contents holder 3200. Alternatively, a magnet may be disposed on one of the upper surface of the holder support unit 3400 and the lower surface of the contents holder 3200, and a metal attracted to the magnet may be disposed on the other of the upper surface of the holder support unit 3400 and the lower surface of the contents holder 3200. When a magnet is disposed on the holder support unit 3400 and a metal is disposed on the contents holder 3200, refilling cost may be reduced.

FIGS. 30, 31, and 32 illustrate a structure in which the magnets 3220 and 3433 are disposed both on the upper surface of the holder support unit 3400 and on the lower surface of the contents holder 3400.

FIG. 35 is an exploded cross-sectional view of modifications of coupling between the contents holder 3200 and the holder support unit 3400 in the stick-type container according to the present invention.

A first magnet 3220A or 3220B and a second magnet 3433A or 3433B may be attached to the upper surface of the holder support unit 3400 and the lower surface of the contents holder 3200, respectively, and the first magnet 3220A or 3220B and the second magnet 3433A or 3433B may be coupled to each other only at a predetermined angle. Referring to FIG. 35, the first magnet 3220A or 3220B and the second magnet 3433A or 3433B may be formed to be inclined corresponding to each other or to be coupled to each other in a concavo-convex coupling manner. However, even when the first magnet 3220A or 3220B and the second magnet 3433A or 3433B are in the form of planar surfaces, the first magnet 3220A or 3220B and the second magnet 3433A or 3433B may be coupled to each other only at a predetermined angle through rotation thereof by the N pole and the S pole thereof. The modifications are not limited by the drawings.

When the elevation member 3300 containing the contents holder 3200 is coupled to the body 3500 by the third movement coupling portion 3350, the third movement coupling portion 3350 of the elevation member 3300 should pass through the coupling recess 3512 disposed at a predetermined position. When the predetermined position is not a position at which the first magnet 3220A or 3220B and the second magnet 3433A or 3433B are capable of being coupled to each other, the contents holder 3200 and the holder support unit 3400 are forcibly rotated and coupled to each other by force of attraction between the first magnet 3220A or 3220B and the second magnet 3433A or 3433B. The holder support unit 3400 and the contents holder 3200 coupled in this way do not perform rotational movement when the elevation member 3300 ascends and descends while rotating. In this case, it is preferable that interlocking portions 3214, 4214, 5214, 3214A, 3214B, 3214C, and 3214D for preventing relative rotational movement between the contents holder 3200 and the elevation member 330 be not provided.

If the interlocking portions 3214, 4214, 5214, 3214A, 3214B, 3214C, and 3214D are provided, the first magnet 3220A or 3220B and the second magnet 3433A or 3433B are preferably omnidirectional magnets that are capable of being coupled to each other without directionality. Alternatively, one part is preferably implemented as the first magnet 3220A or 3220B or the second magnet 3433A or 3433B, and the other part is preferably implemented as a metal plate. In this case, the first or second magnet corresponds to the magnet 3433 in the embodiment shown in the drawings.

If the interlocking portions 3214, 4214, 5214, 3214A, 3214B, 3214C, and 3214D are provided, the elevation member 3330 and the contents holder 3200 need to perform rotational movement relative to the holder support unit 3400 or the body 3500. In this case, the first magnet and the second magnet need to be formed to be rotatable relative to each other.

In FIG. 35, illustration of the interlocking portions is intentionally omitted in order to distinguish the elevation body 3300 from that shown in the other drawings. This is configured substantially differently from the elevation body 3310 shown in FIGS. 30, 31, and 32.

FIG. 32 is a schematic view of the holder and the elevation member in the third embodiment of the stick-type container according to the present invention, and FIG. 33 is an exploded perspective view of a contents holder and an elevation member in fourth and fifth embodiments of the stick-type container according to the present invention.

FIGS. 32 and 33 also show examples of the protruding coupling portion and the interlocking portion.

The contents holder, specifically, the holder 3210, 4210, or 5210, and the elevation member 3300, 4300, or 5300 may be provided with the interlocking portion 3214, 4214, or 5214, which is formed by modifying portions of the sections thereof, so as to be movable only in the longitudinal direction of the stick-type container without performing rotational movement relative to each other when coupled to each other.

The interlocking portion 3214, 4214, or 5214 is implemented by forming the holder 3210, 4210, or 5210 and the elevation member 3300, 4300, or 5300 to have a non-circular cross-section so that the holder 3210, 4210, or 5210 and the elevation member 3300, 4300, or 5300 do not rotate relative to each other when coupled to each other. The interlocking portion may be implemented by forming each of the above components to have a non-rotatable polygonal cross-section or modifying the shape of a portion of the circular cross-section of each of the above components to a linear shape, or may be in the form of a slide and groove. The interlocking portion may be modified variously.

FIG. 32 illustrates a case in which the shape of a portion of the circular cross-section of each of the above components is modified to a linear shape. The left view in FIG. 32 illustrates coupling of the holder 3210 and the elevation member 3300, and the right view in FIG. 32 illustrates a top view, a side view, and a bottom view of the holder 3210.

The right view in FIG. 33 illustrates a slide and groove form. The left view in FIG. 33 illustrates a separate intermediate holder 4305 configured to implement a combination of a slide and groove form and a linear form. A groove is formed in the intermediate holder 4305, and the shape of a portion of the circular cross-section of the intermediate holder 4305 is modified to a linear shape. However, the invention is not limited thereto.

In the configuration shown in the right view in FIG. 33, the interlocking portion 5214 may also serve as the stopper 3320 shown in FIGS. 31 and 35. The interlocking portion 5214 shown in the right view in FIG. 33 allows the holder 5210 and the elevation member 5300 to move only in the longitudinal direction of the stick-type container without performing rotational movement relative to each other when coupled to each other, and also serves as the stopper 3320 shown in FIGS. 31 and 35, that is, allows the contents holder 5200 to be removed together with the elevation member 5300 when the elevation member 5300 is separated to the outside from the body for refilling or the like. In this case, however, it is necessary to forcibly fit the contents holder 5200 into the elevation member 5300 at the initial stage. In this case, the holder 5210 may be fitted into the upper portion or the lower portion of the elevation member 5300.

As shown in FIGS. 32 and 33, when the contents holder and the elevation member are allowed to move only in the longitudinal direction of the stick-type container without performing rotational movement relative to each other, contact or friction between the elevation member and the contents holder occurs only due to raising and lowering of the elevation member, thus minimizing deformation of the contents.

Referring to FIG. 31, for refilling, the elevation member 3300 is used in a state of containing the contents holder 3200 therein. As the contents 3100 on the contents holder 3200 are used, the elevation member 3300 is relatively lowered, thereby continuously exposing the contents 3100 to the outside. After the contents 3100 are completely used, the elevation member 3300 is raised to the uppermost position for refilling. In this case, the third movement coupling portion 3350 of the elevation member 3300 and the first screw 3524 formed on the inner surface of the body 3500 are disengaged from each other. When the elevation member 3300 is raised farther upward and is separated from the body 3500, the contents holder 3200 is also separated by the stopper 3320. The refilling process is identical to that in the configuration shown in FIG. 3.

When the coupling ring 3510 is present, in the state in which the third movement coupling portion 3350 of the elevation member 3300 and the first screw 3524 formed on the inner surface of the body 3500 are disengaged from each other, the elevation member 3300 is rotated to a certain degree so as to be separated from the body 3500 through the coupling recess 3512. In this case, the contents holder 3200 is also separated by the stopper 3320.

For refilling, the third movement coupling portion 3350 of the elevation member 3300 containing a new contents holder 3200 therein is engaged with the first screw 3524 of the body 3500. When the coupling ring 3510 is absent, the lower surface of the contents holder 3200 and the upper surface of the holder support unit 3400 are automatically coupled to each other by the magnets 3220 and 3433. Even when the contents holder 3200 is not located on the bottom of the elevation member 3300, the lower surface of the contents holder 3200 and the upper surface of the holder support unit 3400 may be coupled to each other by the magnets 3220 and 3433, and when the elevation member 3300 is rotated to a certain degree and is lowered, the lower surface of the contents holder 3200 and the upper surface of the holder support unit 3400 become closer to each other, and thus are easily coupled to each other.

In the state in which the coupling ring 3510 is provided, the third movement coupling portion 3350 of the elevation member 3300 passes through the coupling recess 3512 and is rotated to a certain degree to be engaged with the first screw 3524 of the body 3500. The subsequent process is identical to that in the state in which the coupling ring 3510 is absent.

When the coupling ring 3510 is present and the interlocking portion 3214 is absent, the first magnet 3220A or 3220B and the second magnet 3433A or 3433B, which are strongly coupled to each other only at a predetermined angle, are disposed on the upper surface of the holder support unit 3400 and the lower surface of the contents holder 3200, respectively, whereby the position of the contents holder 3200 may be easily fixed by magnetic force. In this case, the magnet 3433 having no directionality may also be used.

When both the coupling ring 3510 and the interlocking portion 3214 are present, the upper surface of the holder support unit 3400 and the lower surface of the contents holder 3200 are coupled to each other by the magnet 3433 having no directionality, and the third movement coupling portion 3350 is rotated to be engaged with the start point of the first screw 3524, thereby preventing the elevation member 3300 from being easily separated.

As described above, the stopper 3320 according to the present invention allows the user to refill the container with contents without getting the contents on his/her hand, unlike the conventional stick-type container that does not take into account problems regarding refilling. When the contents that have been completely used are separated, the contents holder 3200 is conveniently separated merely by separating the elevation member 3300. Since the user performs refilling using only the contents holder 3200, he/she does not need to touch the contents 3100.

The elevation member 3300 containing the contents holder 3200 therein may be sold on the market as a separate refill product with the upper portion thereof and/or the lower portion thereof sealed. Since the stick-type container 3000 according to the present invention is very conveniently refilled with contents, the user may easily use contents with the single body 3500 by interchanging elevation members containing different contents as needed.

The above-described refilling process is equally/similarly applied to the other embodiments shown in all the drawings.

The contents holder 3200 includes a holder 3210 configured to allow the contents 3100 to be loaded on the upper surface thereof, and a protruding coupling portion 3212 is disposed on the upper surface of the holder 3210 so as to be inserted into the contents.

A part configured to be attracted to the magnet of the holder support unit 3400 may be provided on the lower surface of the holder 3210.

FIGS. 32 and 34 are schematic views of various modifications of the protruding coupling portion of the stick-type container according to the present invention.

Unlike the conventional stick-type container, the holder 1210, 3210, 4210, or 5210 according to the present invention does not need a separate partition wall, which may be provided on the upper surface of the holder to contain contents. Further, a rib, which may be disposed inside the partition wall, is not needed. The holder 1210, 3210, 4210, or 5210 according to the present invention includes a protruding coupling portion 1212, 3212, 3212A, 3212B, 3212C, or 3212D formed on the upper surface thereof so as to be inserted into the contents to fix the contents. The protruding coupling portion 1212, 3212, 3212A, 3212B, 3212C, or 3212D is preferably formed such that the cross-sectional area thereof gradually decreases from the upper end thereof to the lower end thereof. However, the shape of the protruding coupling portion is not limited thereto and may be modified variously, so long as the protruding coupling portion is capable of being inserted into the contents to fix the contents.

In the present invention, when the contents are supported only by the protruding coupling portion, it is preferable for the contents to be in the form of semi-solid or solid formulations. Alternatively, it is preferable for the contents to be supported by the elevation member and to easily slide due to low friction between the contents and the elevation member. Alternatively, it is preferable for the contents to have a sufficiently large cross-section and thus to be maintained in shape even when the contents are of a stick type. In the present invention, it was experimentally confirmed that, when the stick-type container according to the present invention was applied to an oil-based cosmetic material in the form of semi-solid formulations, the contents were continuously maintained in shape and a user used the contents to the end.

Meanwhile, since the protruding coupling portion 1212, 3212, 3212A, 3212B, 3212C, or 3212D may directly contact the user's skin as the contents are used, the protruding coupling portion is made of an elastic material. The protruding coupling portion is preferably implemented as an elastic body containing silicone that is harmless to the human body.

The holder 1210 or 3210 includes an interlocking portion 3214, 3214A, 3214B, 3214C, or 3214D, which is formed such that a portion of the cross-section thereof has a non-circular shape or protrudes, and the interlocking portion 3214, 3214A, 3214B, 3214C, or 3214D may be combined with the configurations shown in FIG. 34.

Meanwhile, the body may be provided on the lower end thereof with a fixing portion (not shown) formed to be detachably coupled to a separate support frame.

DESCRIPTION OF REFERENCE NUMERALS

1000, 2000, 3000: stick-type container according to present invention
1100, 3100, 4100, 5100: contents
1200, 3200, 4200, 5200: contents holder
1210, 3210, 4210, 5210: holder
3214, 4214, 5214, 3214A, 3214B, 3214C, 3214D: interlocking portion
1212, 1212A, 1212B, 1212C, 1212D, 3212, 3212A, 3212B, 3212C, 3212D: protruding coupling portion
1216A, 1216B: inner fixing body
1217: inner protruding portion
1220: holder coupling part
3220: holder coupling part (magnet)
3220A, 3220B: first magnet
1230: holder coupling ring
1232: outer peripheral wing
4305: intermediate holder
1300, 3300, 4300, 5300: elevation member
1310, 3310, 4310, 5310: elevation body
1320, 3320: stopper
1330: first movement coupling portion
1340: fourth movement coupling portion
3350, 4350, 5350: third movement coupling portion
1400, 1400A, 1400B, 1400C, 1400D, 1400E, 1400F, 1400G, 3400: holder support unit
1410, 3410: hollow portion
1420, 1420A, 2420, 3420: holder support body
1422, 1422A: protrusion
1424: second screw
1425: baffle
3524: first screw
1430, 1430A: holder moving part
1432, 1432A, 3432: upper coupling portion
1433, 3433: magnet
3433A, 3433B: second magnet
1434, 1434A, 1434B, 1434C, 1434D, 1434F: lower support portion
1440, 1440A, 1440B, 1440C, 1440D, 1440E, 1440F, 1440G: elastic support part
1500, 1500B, 1500C, 1500D, 1500E, 1500F, 1500G, 2500, 3500: body
1510: coupling part
3510: coupling ring
3512: coupling recess
1600, 1600B, 1600C, 1600D, 1600E, 1600F, 1600G: plug
1700A, 1700B, 1700C, 3700: first cap
1700D, 1700E: second cap
1710: first coupling portion
1720, 3720: second coupling portion
1730: protruding portion
1732: pillar
1734: horizontal ring
2800: lower case
F: force

The invention claimed is:

1. A stick-type container comprising:
a contents holder configured to allow contents to be loaded therein;
a body;
an elevation member configured to ascend and descend to adjust exposure of the contents; and
a holder support unit disposed in the body and configured to be detachably coupled to the contents holder to support the contents holder,
wherein the holder support unit comprises:
a holder support body comprising a hollow portion having an empty central portion, having a cylindrical or polyhedral shape, and coupled to the body;
a holder moving part disposed in the hollow portion and comprising an upper coupling portion located at a top thereof and detachably coupled to the contents holder; and
an elastic support part disposed in the hollow portion, located under the upper coupling portion to support the upper coupling portion, and configured to be elastically deformed by pressure applied to the upper coupling portion.

2. The stick-type container according to claim 1, wherein the elastic support part is supported by at least one of a plug coupled to a lower end of the hollow portion, a protrusion protruding from the holder support body toward the hollow portion, or a protruding portion protruding from a lower portion of the body in an upward direction.

3. The stick-type container according to claim 1, wherein the upper coupling portion is restricted in movement range in a downward direction and an upward direction.

4. The stick-type container according to claim 1, wherein a top surface of the upper coupling portion does not protrude beyond a top surface of the holder support body.

5. The stick-type container according to claim 1, wherein the holder moving part further comprises a lower support portion extending from a lower end of the upper coupling portion so as to be disposed in the elastic support part.

6. The stick-type container according to claim 5, wherein the holder moving part has a T-shaped vertical section.

7. The stick-type container according to claim 1, wherein the elevation member comprises a stopper configured to support the contents holder so that the contents holder is not discharged outside through a lower end of the elevation member.

8. The stick-type container according to claim 7, wherein the contents holder is fitted into an upper portion of the elevation member, and wherein, when the contents holder and the elevation member are coupled to each other, the stopper prevents the contents holder from being discharged outside through the lower end of the elevation member.

9. The stick-type container according to claim 1, wherein each of the body, the elevation member, and the contents holder has a circular or polygonal cross-section, wherein the contents holder and the holder support unit are sized to be inserted into the elevation member, and wherein the elevation member is sized to be inserted into the body.

10. The stick-type container according to claim 1, wherein the elevation member comprises:

an elevation body having a cylindrical or prismatic shape; and at least one movement coupling portion protruding from the elevation body in an outward or inward direction of the elevation body or coupled to an outer surface or an inner surface of the elevation body so that the elevation member is supported by the body or the holder support unit.

11. The stick-type container according to claim 1, further comprising a movement coupling portion protruding from an inner surface of the body or an outer surface of the holder support unit or coupled to the inner surface of the body or the outer surface of the holder support unit so that the elevation member is supported by the body or the holder support unit.

12. The stick-type container according to claim 1, wherein the elevation member is raised and lowered by rotation of the body or the holder support unit.

13. The stick-type container according to claim 1, further comprising:

a screw formed on an inner surface of the body; and a movement coupling portion protruding from an outer surface of the elevation member and configured to be movable along the screw.

14. The stick-type container according to claim 13, further comprising a coupling ring in a form of a circular or polygonal ring, the coupling ring including a coupling recess formed in an upper end thereof so as to allow the movement coupling portion to pass therethrough and coupled to an upper end of the body.

15. The stick-type container according to claim 14, wherein the coupling recess and a start point of the first screw are disposed so as to be misaligned from each other.

16. The stick-type container according to claim 1, further comprising:

a screw formed on an outer surface of the holder support body; and a movement coupling portion protruding from an inner surface of the elevation member and configured to be movable along the screw.

17. The stick-type container according to claim 16, further comprising a ring-shaped coupling portion separately coupled to an upper end of the body.

18. The stick-type container according to claim 1, wherein the upper coupling portion and the contents holder are detachably coupled to each other in at least one manner selected from the group consisting of a magnetic-coupling manner, a fitting-coupling manner, and an adhesive-coupling manner.

19. The stick-type container according to claim 18, further comprising a magnet provided on at least one of the upper coupling portion or a lower surface of the contents holder.

20. The stick-type container according to claim 1, wherein the contents holder and the elevation member are provided with an interlocking portion configured to allow the contents holder and the elevation member to move only in a longitudinal direction of the stick-type container without rotating relative to each other when coupled to each other.

21. The stick-type container according to claim 1, wherein the contents holder comprises at least one of:

a holder configured to allow the contents to be loaded on an upper surface thereof;

an inner fixing body comprising a side groove formed therein so as to allow the contents to be fitted thereinto; or an inner protruding portion configured to be fitted into the contents to fix the contents, and wherein the holder comprises a protruding coupling portion disposed on an upper surface thereof so as to be inserted into the contents.

22. The stick-type container according to claim 21, wherein the protruding coupling portion comprises an elastic material.

23. The stick-type container according to claim 21, wherein the contents holder further comprises:

a holder coupling part disposed under the holder and made of a metallic or magnetic material; and a holder coupling ring configured to couple the holder coupling part to the holder.

24. A refill cartridge comprising:

a contents holder configured to allow contents to be loaded therein; and an elevation member formed in a shape of a hollow cylinder or a hollow prism and configured to allow the contents and the contents holder to be disposed therein, wherein the contents holder is fitted into an upper portion of the elevation member, wherein the contents holder is prevented, by a stopper protruding from a lower end of the elevation member, from being discharged outside through the lower end of the elevation member, wherein the contents holder comprises at least one of:

a holder configured to allow the contents to be loaded on an upper surface thereof;

an inner fixing body comprising a side groove formed therein so as to allow the contents to be fitted thereinto; or an inner protruding portion configured to be fitted into the contents to fix the contents, wherein the holder comprises a protruding coupling portion disposed on an upper surface thereof so as to be inserted into the contents, wherein the protruding coupling portion comprises an elastic material, and wherein the contents holder further comprises:

a holder coupling part disposed under the holder and made of a metallic or magnetic material; and a holder coupling ring configured to couple the holder coupling part to the holder.

25. The refill cartridge according to claim 24, wherein the elevation member is formed in a shape of a hollow cylinder or a hollow prism having an open top and a partially open bottom, and wherein the stopper is disposed on a lower surface of the elevation member so as to protrude from a peripheral portion of the elevation member.

* * * * *